US010670979B2

(12) United States Patent
Nakata et al.

(10) Patent No.: US 10,670,979 B2
(45) Date of Patent: Jun. 2, 2020

(54) ELECTROPHOTOGRAPHIC PHOTOSENSITIVE MEMBER, ELECTROPHOTOGRAPHIC APPARATUS, PROCESS CARTRIDGE, AND METHOD OF MANUFACTURING ELECTROPHOTOGRAPHIC PHOTOSENSITIVE MEMBER

(71) Applicant: CANON KABUSHIKI KAISHA, Tokyo (JP)

(72) Inventors: Koichi Nakata, Tokyo (JP); Haruki Mori, Ichikawa (JP); Shinji Takagi, Yokohama (JP); Koichi Suzuki, Yokohama (JP); Ryuji Higashi, Kawasaki (JP); Isao Kawata, Kawasaki (JP); Hajime Muta, Zama (JP); Yuto Ito, Koganei (JP); Masaki Nonaka, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/980,806

(22) Filed: May 16, 2018

(65) Prior Publication Data

US 2018/0335708 A1 Nov. 22, 2018

(30) Foreign Application Priority Data

May 22, 2017 (JP) ..... 2017-101077

(51) Int. Cl.
*G03G 5/05* (2006.01)
*G03G 5/06* (2006.01)
*G03G 5/07* (2006.01)

(52) U.S. Cl.
CPC ..... *G03G 5/0546* (2013.01); *G03G 5/0532* (2013.01); *G03G 5/0542* (2013.01); *G03G 5/0603* (2013.01); *G03G 5/0607* (2013.01); *G03G 5/0614* (2013.01); *G03G 5/073* (2013.01)

(58) Field of Classification Search
CPC .. G03G 5/0546; G03G 5/0532; G03G 5/0542; G03G 5/0614
USPC ..... 430/58.7
See application file for complete search history.

(56) References Cited

U.S. PATENT DOCUMENTS 3,839,033 A 10/1974 Matsuno et al.
4,316,947 A 2/1982 Suzuki et al.
4,338,389 A 7/1982 Suzuki et al.
4,382,917 A 5/1983 Suzuki et al.
4,461,753 A 7/1984 Suzuki et al.
5,024,912 A 6/1991 Neishi et al.
5,098,809 A * 3/1992 Kikuchi ..... C07C 211/61 430/73
5,126,223 A 6/1992 Kikuchi et al.
5,219,688 A 6/1993 Kashizaki et al.
5,278,013 A 1/1994 Kashizaki et al.
5,288,575 A 2/1994 Kashizaki et al.
5,356,746 A 10/1994 Sugiyama et al.
5,453,342 A 9/1995 Go et al.
5,468,584 A 11/1995 Go et al.
5,486,440 A 1/1996 Kashizaki et al.
5,488,461 A 1/1996 Go et al.
5,543,257 A 8/1996 Suzuki et al.
5,576,131 A 11/1996 Takai et al.
(Continued)

FOREIGN PATENT DOCUMENTS

JP 2007-011005 1/2007
JP 2007-011006 1/2007
(Continued)

OTHER PUBLICATIONS

U.S. Appl. No. 15/969,836, filed May 3, 2018, Haruki Mori.
U.S. Appl. No. 16/002,421, filed Jun. 7, 2018, Koichi Nakata.

*Primary Examiner* — Christopher D Rodee
(74) *Attorney, Agent, or Firm* — Venable LLP

(57) ABSTRACT

An electrophotographic photosensitive member has a surface layer that contains a polymer of a hole transport material having at least one monovalent polymerizable functional group. The hole transport material is represented by Formula (1)

(1)

where n is an integer of 1 to 5, $Z^1$ is represented by Formula (2)

(2)

$Z^2$ is a hydrogen atom or the group represented by Formula (2), and the monovalent polymerizable functional group is represented by Formula (3)

(3)

6 Claims, 2 Drawing Sheets

(56) References Cited

U.S. PATENT DOCUMENTS

| | | | | |
|---|---|---|---|---|
| 5,622,799 | A | 4/1997 | Suzuki et al. | |
| 5,695,898 | A | 12/1997 | Go et al. | |
| 5,837,412 | A | 11/1998 | Suzuki et al. | |
| 5,932,383 | A | 8/1999 | Nakata et al. | |
| 6,248,490 | B1 | 6/2001 | Suzuki et al. | |
| 6,432,603 | B1 | 8/2002 | Kimura et al. | |
| 6,773,856 | B2 | 8/2004 | Tanaka et al. | |
| 7,186,489 | B2 | 3/2007 | Uematsu et al. | |
| 7,226,711 | B2 | 6/2007 | Amamiya et al. | |
| 7,245,851 | B2 | 7/2007 | Fujii et al. | |
| 7,333,752 | B2 | 2/2008 | Kawahara et al. | |
| 7,534,534 | B2 | 5/2009 | Nakata et al. | |
| 7,732,113 | B2 | 6/2010 | Nakamura et al. | |
| 7,910,274 | B2 | 3/2011 | Tanaka et al. | |
| 8,088,541 | B2 | 1/2012 | Tanaka et al. | |
| 8,343,699 | B2 | 1/2013 | Nagasaka et al. | |
| 8,415,078 | B2 | 4/2013 | Tanaka et al. | |
| 8,465,889 | B2 | 6/2013 | Sekido et al. | |
| 8,524,430 | B2 | 9/2013 | Takagi et al. | |
| 8,546,050 | B2 | 10/2013 | Maruyama et al. | |
| 8,632,931 | B2 | 1/2014 | Sekido et al. | |
| 8,783,209 | B2 | 7/2014 | Kaku et al. | |
| 8,795,936 | B2 | 8/2014 | Sekido et al. | |
| 9,034,543 | B2 * | 5/2015 | Iwadate | G03G 5/0618 430/58.7 |
| 9,244,369 | B2 | 1/2016 | Tanaka et al. | |
| 9,256,143 | B2 * | 2/2016 | Black | G03G 5/0614 |
| 9,316,931 | B2 | 4/2016 | Takagi et al. | |
| 9,389,523 | B2 | 7/2016 | Nakata et al. | |
| 9,594,318 | B2 | 3/2017 | Nakata et al. | |
| 9,740,117 | B2 * | 8/2017 | Kosaka | C08F 2/50 |
| 9,851,648 | B2 | 12/2017 | Nishi et al. | |
| 9,927,727 | B2 * | 3/2018 | Luo | G03G 5/0525 |
| 9,946,175 | B2 * | 4/2018 | Nakata | G03G 5/0564 |
| 2002/0119382 | A1 * | 8/2002 | Nakata | G03G 5/0614 430/66 |
| 2004/0043312 | A1 * | 3/2004 | Kikuchi | G03G 5/0614 430/56 |
| 2007/0257603 | A1 | 11/2007 | Suzuki et al. | |
| 2011/0076605 | A1 * | 3/2011 | Doi | G03G 5/051 430/58.7 |
| 2014/0072906 | A1 * | 3/2014 | Iwadate | G03G 5/0514 430/56 |
| 2017/0299971 | A1 | 10/2017 | Mori et al. | |
| 2017/0364025 | A1 | 12/2017 | Nakata et al. | |

FOREIGN PATENT DOCUMENTS

| | | |
|---|---|---|
| JP | 2007-204425 | 8/2007 |
| JP | 2007-272191 | 10/2007 |
| JP | 2007-272192 | 10/2007 |
| JP | 2007-279678 | 10/2007 |
| JP | 2008-070761 | 3/2008 |
| JP | 2012150164 A * | 8/2012 |
| JP | 2012185419 A * | 9/2012 |
| JP | 2016-051030 | 4/2016 |

* cited by examiner

ELECTROPHOTOGRAPHIC PHOTOSENSITIVE MEMBER, ELECTROPHOTOGRAPHIC APPARATUS, PROCESS CARTRIDGE, AND METHOD OF MANUFACTURING ELECTROPHOTOGRAPHIC PHOTOSENSITIVE MEMBER

BACKGROUND OF THE INVENTION

Field of the Invention

The present invention relates to an electrophotographic photosensitive member, an electrophotographic apparatus, a process cartridge, and a method of manufacturing an electrophotographic photosensitive member.

Description of the Related Art

A surface layer of an electrophotographic photosensitive member is required to have abrasion resistance and chemical stability since stress caused by a series of electrophotographic processes such as charging, exposure, development, transfer, and cleaning is repeatedly received.

In order to improve the abrasion resistance, a method of containing a curable resin in the surface layer of the electrophotographic photosensitive member may be used. However, when a surface layer having a high abrasion resistance is provided, since the surface layer is difficult to abrade, removal according to abrasion of a chemically deteriorated surface layer has not implemented, and thus chemical deterioration is easily accumulated on a surface. Chemical deterioration is a phenomenon in which a hole transport material (hole transport compound) causes a chemical change due to the stress caused by the above-described series of electrophotographic processes. The chemical change of the hole transport material may cause a phenomenon that the electrophotographic image output after repeatedly used in a high temperature and high humidity environment becomes unclear (hereinafter, also referred to as an image flow). Accordingly, in order to suppress the image flow, it is required to suppress the chemical change of the hole transport material.

By containing a fluorine atom or a specific fluorinated alkyl group in a structure of the hole transport material, deterioration of the hole transport material may be suppressed. It is considered that surface energy of the surface layer of the photosensitive member is optimally adjusted and affinity for water, discharge products, or the like, is reduced by having a fluorine atom or a specific fluorine atom-containing substituent. However, when the hole transport material has the fluorine atom or the fluorine atom-containing substituent, there is a case where potential variation is increased when used for a long period under a low humidity environment.

Japanese Patent Application Laid-Open No. 2007-11005 discloses a technique for improving an image flow by adding a specific fluorine atom-containing monomer having a polymerizable functional group to a surface layer. Japanese Patent Application Laid-Open No. 2007-11006 and Japanese Patent Application Laid-Open No. 2016-51030 disclose a technique for having a specific hole transport monomer containing fluorine atoms in a surface layer. Japanese Patent Application Laid-Open No. 2007-272191, Japanese Patent Application Laid-Open No. 2007-272192, and Japanese Patent Application Laid-Open No. 2007-279678 disclose techniques for improving image flow by adding a specific amine compound to a surface layer. Japanese Patent Application Laid-Open No. 2008-70761 discloses a technique for adding a specific siloxane compound having a specific polymerizable functional group to a surface layer. Japanese Patent Application Laid-Open No. 2007-204425 discloses a fluorene compound having the same structural unit as a hole transport material according to the present invention.

SUMMARY OF THE INVENTION

An electrophotographic photosensitive member according to an aspect of the present invention includes: a support and a photosensitive layer on the support, wherein a surface layer of the electrophotographic photosensitive member contains a polymer of a hole transport compound represented by Formula (1) below,

[Formula (1)]

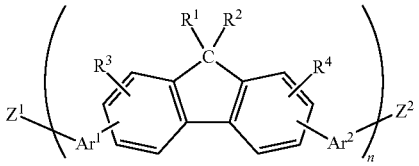

(where the hole transport compound represented by Formula (1) has at least one monovalent polymerizable functional group, in Formula (1), $R^1$ and $R^2$ each independently represent a hydrogen atom, a fluorine atom, an alkyl group, a fluorine atom-substituted alkyl group, a phenyl group-substituted alkyl group, a phenyl group, or an alkyl group-substituted phenyl group, or an alkyl group having a monovalent polymerizable functional group as a substituent, a phenyl group-substituted alkyl group having a monovalent polymerizable functional group as a substituent, a phenyl group having a monovalent polymerizable functional group as a substituent, or an alkyl group-substituted phenyl group having a monovalent polymerizable functional group as a substituent, $R^3$ and $R^4$ each independently represent a hydrogen atom, an alkyl group, an alkoxy group, or a phenyl group, or an alkyl group having a monovalent polymerizable functional group as a substituent, or an alkoxy group having a monovalent polymerizable functional group as a substituent, or a phenyl group having a monovalent polymerizable functional group as a substituent, $Ar^1$ and $Ar^2$ each independently represent a single bond, an arylene group, and an alkyl group-substituted arylene group, n represents an integer of 1 or more to 5 or less, when n is 2 or more, structures in parentheses may be the same as or different from each other, at least one of n $R^1$ and n $R^2$ is a fluorine atom or a fluorine atom-substituted alkyl group, $Z^1$ represents a monovalent group represented by Formula (2) below, $Z^2$ represents a hydrogen atom or a monovalent group represented by Formula (2) below, when $Z^2$ is a monovalent group represented by Formula (2) below, $Z^1$ and $Z^2$ may be the same as or different from each other,

[Formula (2)]

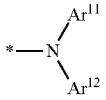

in Formula (2), * represents a bonding position at which $Ar^1$ or $Ar^2$ is bonded, and $Ar^{11}$ and $Ar^{12}$ each independently represent an aryl group, an alkyl group-substituted aryl group, an alkoxy group-substituted aryl group, or an aryl group having a monovalent polymerizable functional group as a substituent, an alkyl group-substituted aryl group having a monovalent polymerizable functional group as a substituent, or an alkoxy group-substituted aryl group having a monovalent polymerizable functional group as a substituent).

In addition, another embodiment of the present invention relates to an electrophotographic apparatus including the electrophotographic photosensitive member; and at least one unit selected from a charging unit, an exposing unit, a developing unit, and a transfer unit.

In addition, still another embodiment of the present invention relates to a process cartridge including the electrophotographic photosensitive member; and at least one unit that are integrally supported, the at least one unit being selected from a charging unit, a developing unit, and a cleaning unit, and being detachably attachable to an electrophotographic apparatus main body.

Further, still another embodiment of the present invention relates to a method of manufacturing an electrophotographic photosensitive member.

Further features of the present invention will become apparent from the following description of exemplary embodiments with reference to the attached drawings.

DESCRIPTION OF THE EMBODIMENTS

Figure 1:
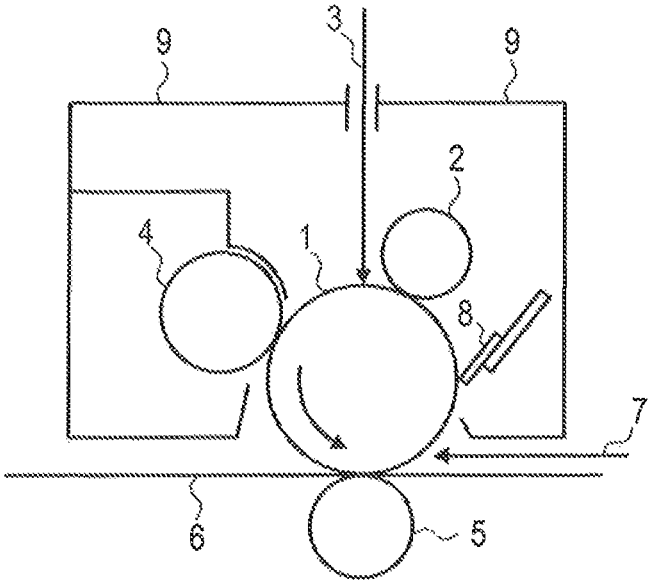
FIG. 1 is a schematic view showing an example of a process cartridge including an electrophotographic photosensitive member according to an embodiment of the present invention.

Preferred embodiments of the present invention will now be described in detail in accordance with the accompanying drawings.

Techniques using compounds of Japanese Patent Application Laid-Open No. 2007-11005, Japanese Patent Application Laid-Open No. 2007-272191, Japanese Patent Application Laid-Open No. 2007-272192, Japanese Patent Application Laid-Open No. 2007-279678, and Japanese Patent Application Laid-Open No. 2008-70761 are techniques for alleviating the above-described stress exposure to a hole transport material, and are not techniques for improving chemical stability as the hole transport material. In addition, Japanese Patent Application Laid-Open No. 2007-11006 discloses a purpose of forming a surface layer to have low-surface energy. However, there is no disclosure concerning chemical deterioration of a surface layer, and there is no disclosure concerning potential variation when repeatedly used under a low humidity environment. A technique disclosed in Japanese Patent Application Laid-Open No. 2016-51030 does not describe suppression of potential variation when repeatedly used under a low humidity environment. A technique disclosed in Japanese Patent Application Laid-Open No. 2007-204425 is related to a fluorene compound and an organic light emitting device, and does not disclose an application into a protection layer of an electrophotographic photosensitive member.

In recent years, high durability of the electrophotographic photosensitive member is remarkably progressed, and demand for improving image flow is increasing. In order to improve the image flow, it is required not only to alleviate the above-described stress exposure, but also to improve chemical stability of the hole transport material itself. It is also required to have high abrasion resistance and to suppress potential variation that may occur when the electrophotographic photosensitive member including a hole transport material containing a fluorine atom is used for a long time under a specific low humidity environment.

Accordingly, an embodiment of the present invention is to provide an electrophotographic photosensitive member in which abrasion resistance is high, image flow is effectively suppressed, and potential variation when repeatedly used under a low humidity environment is suppressed. In addition, another embodiment of the present invention is to provide an electrophotographic apparatus and a process cartridge having the electrophotographic photosensitive member. Still another embodiment of the present invention is to provide a method of manufacturing an electrophotographic photosensitive member.

The present invention relates to an electrophotographic photosensitive member in which a surface layer contains a polymer of a hole transport compound having a polymerizable functional group, and the hole transport compound has a specific fluorene structure. The specific fluorene structure is characterized by having a fluorine atom or a fluorinated alkyl group at a specific site. Hereinafter, a hole transport material having the polymerizable functional group having the characteristics is also referred to as a hole transport material according to the present invention.

In general, an arylamine compound having excellent hole transport property is widely used as a hole transport material used in an electrophotographic photosensitive member.

It is considered that hole transportability of the arylamine compound is expressed by the fact that the amine structure shows electron-donating property, forms a molecular orbital with respect to an aryl group and the like around a nitrogen atom, and causes a redox reaction. Meanwhile, through repetition of an electrophotographic process, an arylamine moiety is considered to be in a state that is susceptible to chemical reaction or the like, since exchange of charge is performed actively. In particular, it is considered that the arylamine moiety tends to be susceptible to a change of oxidation, or the like, due to discharge energy in a charging process, or an action of ozone or an oxidizing material that occurs by a discharge phenomenon. As a result, it is presumed that the chemical change of the arylamine moiety is caused. Further, it is considered that a combination of the chemical change of the hole transport material and high temperature and high humidity environment causes a decrease in resistance of a surface of the photosensitive member, and thus image defects such as a so-called image flow, and the like, occur.

The present inventors searched a hole transport material in which chemical change by repeated use is suppressed even though the hole transport material has an amine structure, and completed the present invention.

That is, the hole transport material according to the present invention has the following characteristics. In order to suppress the chemical change of the aromatic amine-based hole transport material, the hole transport material according to the present invention is formed by a structure having a fluorine atom at a specific site in a molecule.

The present inventors reviewed intensively, and as a result, found that when a polymer of a hole transport material according to the present invention was used for a surface layer of a photosensitive member, the surface layer of the photosensitive member has high abrasion resistance, suppressed image flow, and suppressed potential variation after repeatedly used under a low humidity environment.

It is considered that this is because the hole transport material according to the present invention is capable of having both chemical stability and electric characteristics by having a fluorine atom and an alkyl group containing the fluorine atom at a site that does not adversely affect a hole transport function.

The hole transport material according to the present invention is a compound represented by Formula (1), and has a fluorene structure in which at least one of n $R^1$ and n $R^2$ is a fluorine atom or a fluorine atom-substituted alkyl group. The fluorine atom and an alkyl group having the fluorine atom may be bonded to only 9-position of the so-called fluorene structure.

The fluorene structure is formed so that a 5-membered ring and a 6-membered ring are condensed, and has a high planarity. Meanwhile, only the carbon atom positioned at the 9-position of the fluorene structure is a carbon atom forming an sp3 hybrid orbit, and has a bonding position relationship protruding from a plane formed by three condensed rings. A linking group bonded to the 9-positioned carbon atom is not present in the same plane as a plane formed by the fluorene structure. In addition, due to an sp3 carbon atom, it does not directly bond to a conjugation structure formed by an sp2 carbon atom, but has a positional relationship which is difficult to affect in an organic electron viewpoint even if being present in the vicinity.

For this reason, it is presumed that a fluorine atom and an alkyl group having the fluorine atom are capable of being present in the vicinity of an aromatic amino group of the hole transport material, while improving deterioration resistance without hindering hole transportability. That is, it is required that the fluorine atom and the alkyl group having the fluorine atom bind to the aromatic amino group while having specific atomic spacing and positional relationship, and are present in the same molecule.

In the hole transport structure of Formula (1), $R^1$ and $R^2$ which are bonded to the 9-position of the fluorene structure are each independently a hydrogen atom, a fluorine atom, an alkyl group, a fluorine atom-substituted alkyl group, a phenyl group-substituted alkyl group, a phenyl group, an alkyl group-substituted phenyl group, or the like. When $R^1$ and $R^2$ are the fluorine atom-substituted alkyl groups, it is considered that if a carbon chain of the fluorinated alkyl group becomes larger, the hole transportability is hindered by being stereoscopically close to the aromatic amino group, or the like. Therefore, the number of carbon atoms of the fluorinated alkyl group is 6 or less, and more preferably 4 or less. More preferably, a methyl group or an ethyl group having a fluorine atom is preferred, and a trifluoromethyl group is most preferred.

As the fluorinated alkyl group, a monofluoromethyl group, a difluoromethyl group, a trifluoromethyl group, 1,1-difluoroethyl group, 2,2,2,-trifluoroethyl group, 1,2,2-trifluoroethyl group, 1,1,2,2,-tetrafluoroethyl group, 1,1,2,2,2,-pentafluoroethyl group, 1,1-difluoropropyl group, 3,3,3-trifluoropropyl group, 2,2,3,3,3-pentafluoropropyl group, 4,4,4-trifluorobutyl group, 3,3,4,4,4-pentafluorobutyl group, and the like, may be included.

The reason why the above condition is preferred is considered as follows. It is considered that the fluorine atom and the fluorinated alkyl group have a high electronegativity to thereby exhibit an action of hindering the hole transport property when the fluorine atom and the fluorinated alkyl group are extremely close to the triarylamine structure having the hole transport property. In addition, the fluorinated alkyl group, and the like, have a large volume and a repulsive action with each other, and are turned to a direction of a triarylamine structure when the number of carbon atoms becomes larger, i.e., are close to the triarylamine structure, and thus the fluorinated alkyl group is considered to cause hindering of the hole transport property due to steric hindrance with respect to charge transport. Particularly, when the number of carbon atoms is excessively large, a tendency to hinder the hole transport property is increased.

Even in an alkyl group in which $R^1$ and $R^2$ have no fluorine atom, or the like, the number of carbon atoms is preferably 8 or less, and more preferably 6 or less, since there is a risk that the hole transport property may be hindered when the number of carbon atoms is excessively large. In the alkyl group having no fluorine atom, or the like, examples of the alkyl group may include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexyl methyl group, a 4-tert-butylcyclohexyl group, an n-heptyl group, a cycloheptyl group, and the like.

In Formula (1) above, $R^3$ and $R^4$ are each independently a hydrogen atom, an alkyl group, an alkoxy group, a phenyl group, and the like. In the alkyl group and the alkoxy group, the number of carbon atoms is preferably 6 or less, and more preferably 4 or less.

Examples of the alkyl group may include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a cyclohexyl group, a 1-methylhexyl group, a cyclohexyl methyl group, a 4-tert-butylcyclohexyl group, an n-heptyl group, a cycloheptyl group, and the like.

Examples of the alkoxy group may include a methoxy group, an ethoxy group, an n-propoxy group, an isopropoxy group, an n-butoxy group, an isobutoxy group, a sec-butoxy group, a tert-butoxy group, an n-pentyloxy group, an n-hexyloxy group, and the like.

$Ar^1$ and $Ar^2$ in Formula (1) each independently represent a single bond, an arylene group, and an alkyl group-substituted arylene group. Examples of the arylene group may include a divalent group obtained from a phenylene group, a naphthylene group, anthracene, pyrene, fluorene, fluoranthene, triphenylene, or the like. The single bond or the phenylene group is preferable so that a hole transport material molecule does not have an excessively large volume structure and a molecular weight is not excessively increased. When the arylene group has an alkyl group as a substituent, an alkyl group having 6 or less carbon atoms is preferred. Examples of the alkyl group may include a methyl group, an ethyl group, an n-propyl group, an isopropyl group, an n-butyl group, an isobutyl group, a sec-butyl group, a tert-butyl group, an n-pentyl group, an isopentyl group, a neopentyl group, a tert-pentyl group, a cyclopentyl group, an n-hexyl group, a 1-methylpentyl group, a 4-methyl-2-pentyl group, a 3,3-dimethylbutyl group, a 2-ethylbutyl group, a cyclohexyl group, and the like.

In Formula (1), n represents the number of fluorene structures of the hole transport material and is an integer of 1 or more to 5 or less. When n is 2 or more, structures in parentheses may be the same as or different from each other. From the viewpoint that a structure in which the molecular weight is not excessively large is preferable, n is preferably an integer of 1 or more to 3 or less, and further more preferably 1 or 2.

$Ar^{11}$ and $Ar^{12}$ of $Z^1$ and $Z^2$ each independently represent an aryl group, an alkyl group-substituted aryl group, an alkoxy group-substituted aryl group, or an aryl group having a monovalent polymerizable functional group as a substituent, an alkyl group-substituted aryl group having a monovalent polymerizable functional group as a substituent, or an alkoxy group-substituted aryl group having a monovalent polymerizable functional group as a substituent. The aryl group of $Ar^{11}$ and $Ar^{12}$ is preferably a phenyl group, a naphthyl group, an anthracenyl group, a phenanthrenyl group, or a pyrenyl group, and particularly preferably a phenyl group. The alkyl group and the alkoxy group that are the substituents of $Ar^{11}$ and $Ar^{12}$ are preferably groups having 6 or less carbon atoms. Examples of the alkyl group and the alkoxy group may include the same groups as described above.

The hole transport material according to the present invention has at least one monovalent polymerizable functional group. Further, the hole transport material preferably has two or more polymerizable functional groups. The polymerizable functional group means a functional group capable of forming a covalent bond between molecules when the polymerizable functional groups cause a polymerization reaction. For example, the following polymerizable functional groups may be included.

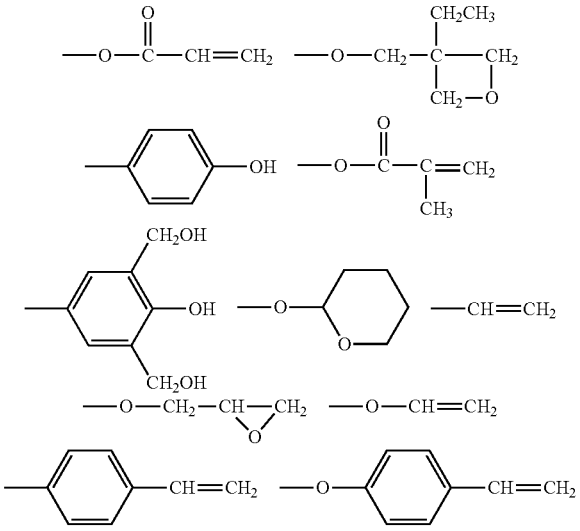

From the viewpoints of abrasion resistance of the surface layer and a polymerization reaction rate in polymerization after film formation, the polymerizable functional group is preferably a functional group having chain polymerizability. Particularly, an acryloyloxy group and a methacryloyloxy group are preferred.

When $R^1$ to $R^4$, $Ar^{11}$, and $Ar^{12}$ have a polymerizable functional group, a divalent linking group between the polymerizable functional group and a fluorene structure is preferably provided for the purpose of improving polymerization characteristics of a hole transport material, improving a melting point, and further improving film formation, fluidity at the time of curing, and physical properties of a polymer, and the like. As the linking group, a linear or branched alkylene group or an oxyalkylene group may be included.

That is, a substituent including the polymerizable functional group to be introduced preferably has a structure represented by Formula (3) below.

[Formula (3)]

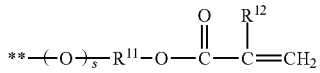

(In Formula (3), ** represents bonding positions at which $R^1$ to $R^4$, $Ar^{11}$, and $Ar^{11}$ are bonded. $R^{11}$ represents a single bond or an alkylene group having 6 or less carbon atoms. $R^{12}$ represents a hydrogen atom or a methyl group. s is 0 or 1. Provided that s is 1, $R^{11}$ is not a single bond. When the number of groups having a monovalent polymerizable functional group is 2 or more, structures of the groups having a monovalent polymerizable functional group may be the same as or different from each other).

$R^{11}$ is preferably an alkylene group having 2 to 5 carbon atoms.

Examples of the alkylene group represented by $R^{11}$ may include a methylene group, an ethylene group, an n-propylene group, an iso-propylene group, an n-butylene group, an iso-butylene group, a sec-butylene group, a tert-butylene group, an n-pentyl group, 1-methyl-n-butylene group, 2-methyl-n-butylene group, 3-methyl-n-butylene group, 1,1-dimethyl-n-propylene group, 1,2-dimethyl-n-propylene group, 2,2-dimethyl-n-propylene group, and the like.

Other polymerizable functional group may be included in one molecule or between molecules of the hole transport material. As a unit for polymerizing the polymerizable functional group, a unit for imparting energy such as ultraviolet rays, electron beams, heat, or the like, or a unit for coexisting a compound such as an auxiliary agent including a polymerization initiator, an acid, an alkali, a complex, or the like, can be used.

A compound example of the hole transport material according to the present invention is shown below. However, the present invention is not limited thereto. A polymerizable functional group of the following Exemplary Compound may be substituted with any one of the above-described various polymerizable functional groups. Similarly, a substituent may also be substituted with the above-described substituent.

[Exemplary Compound No. 1]
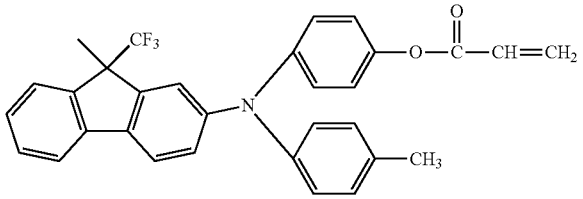
[Exemplary Compound No. 2]
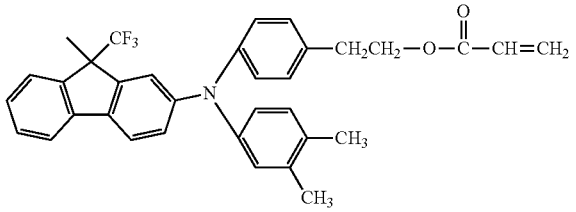
[Exemplary Compound No. 3]
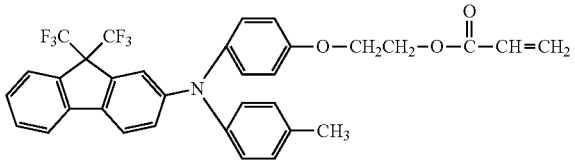
[Exemplary Compound No. 4]
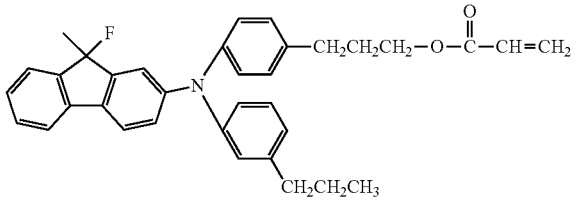
[Exemplary Compound No. 5]
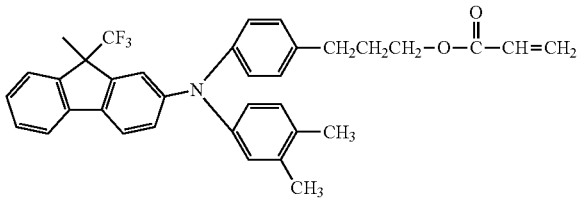
[Exemplary Compound No. 6]
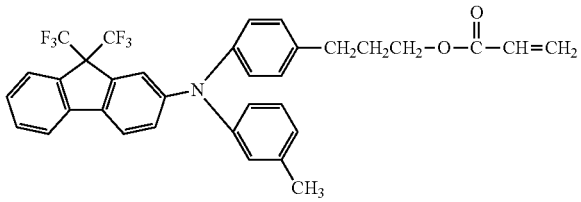
[Exemplary Compound No. 7]
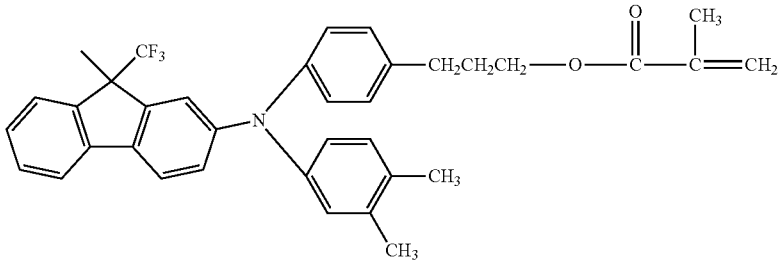
[Exemplary Compound No. 8]
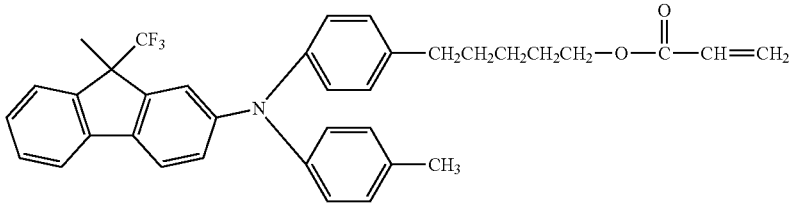
[Exemplary Compound No. 9]
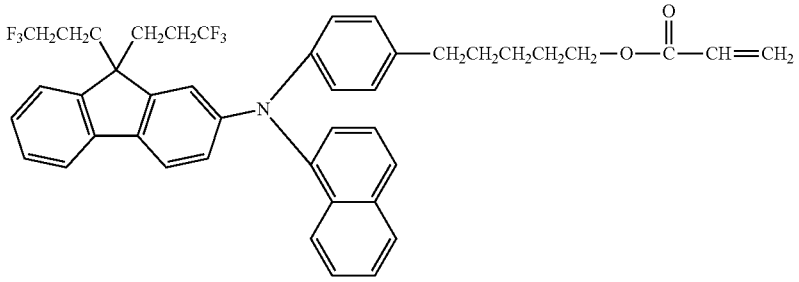

-continued
[Exemplary Compound No. 10]
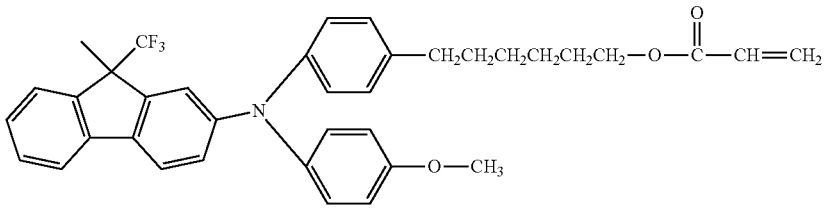
[Exemplary Compound No. 11]
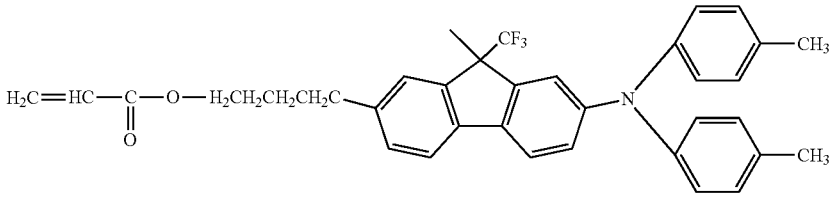
[Exemplary Compound No. 12]
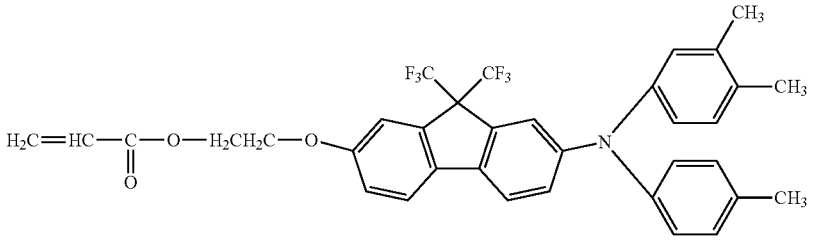
[Exemplary Compound No. 13]
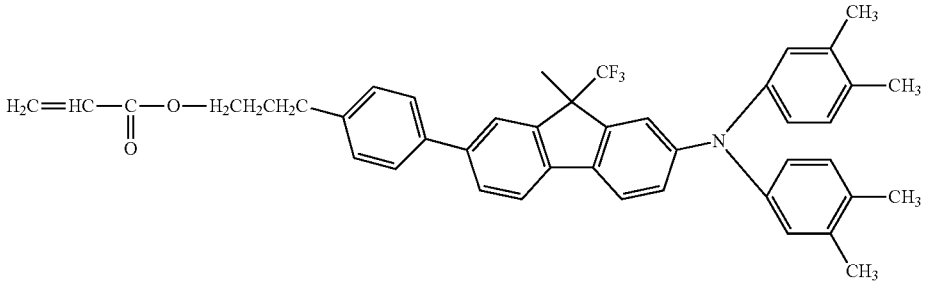
[Exemplary Compound No. 14]
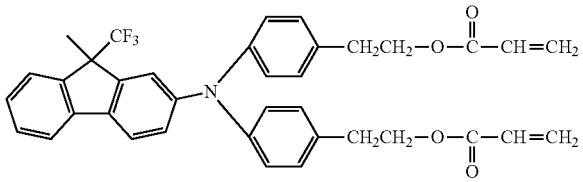
[Exemplary Compound No. 15]
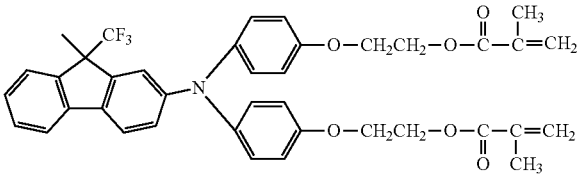
[Exemplary Compound No. 16]
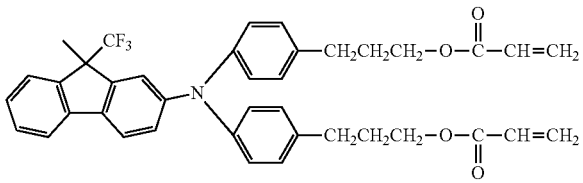
[Exemplary Compound No. 17]
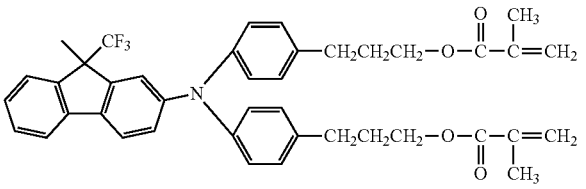

-continued
[Exemplary Compound No. 18]
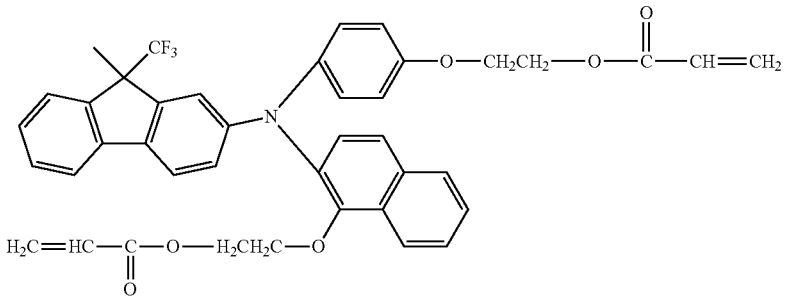
[Exemplary Compound No. 19]
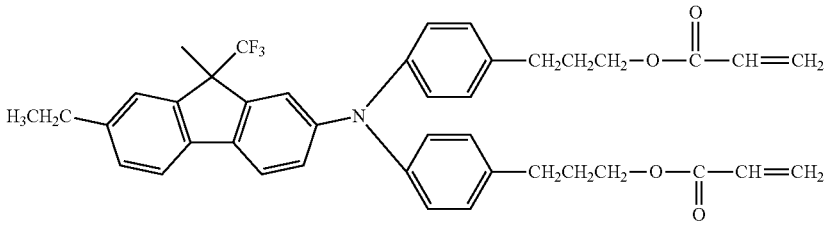
[Exemplary Compound No. 20]
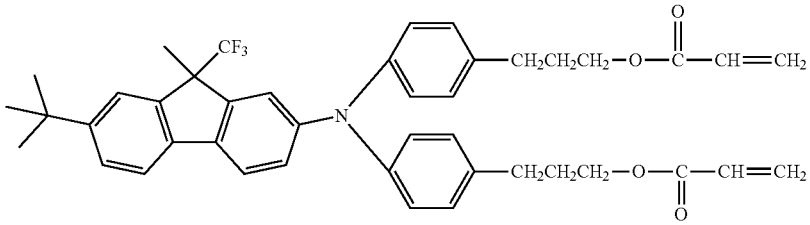
[Exemplary Compound No. 21]
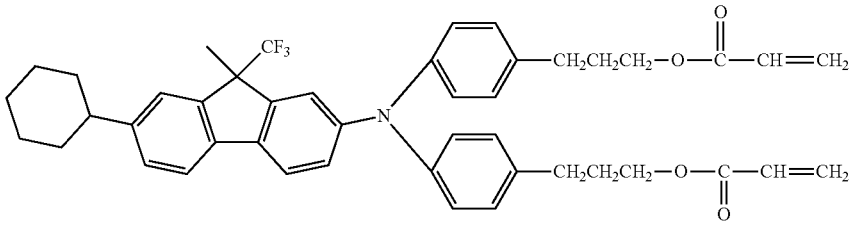
[Exemplary Compound No. 22]
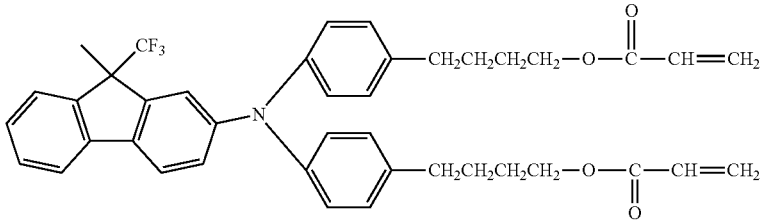
[Exemplary Compound No. 23]
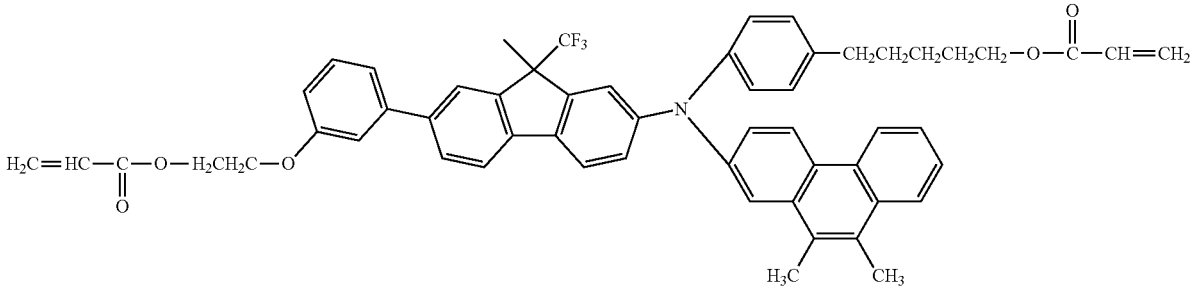

-continued
[Exemplary Compound No. 24]
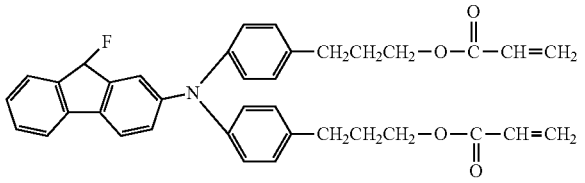
[Exemplary Compound No. 25]
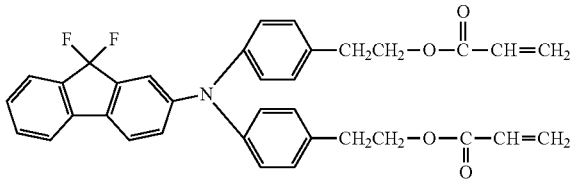
[Exemplary Compound No. 26]
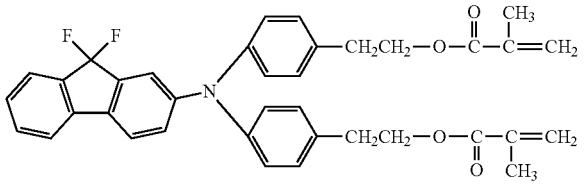
[Exemplary Compound No. 27]
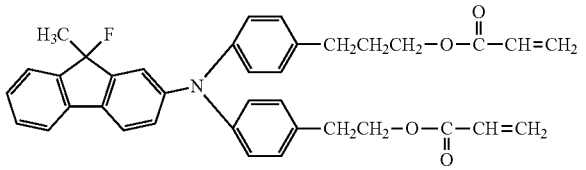
[Exemplary Compound No. 28]
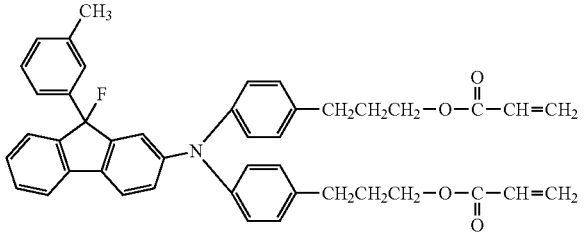
[Exemplary Compound No. 29]
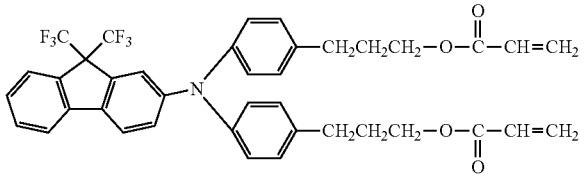
[Exemplary Compound No. 30]
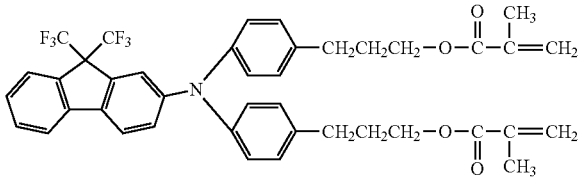
[Exemplary Compound No. 31]
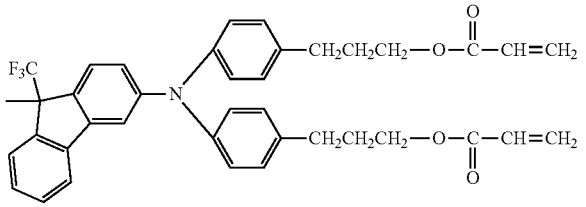
[Exemplary Compound No. 32]
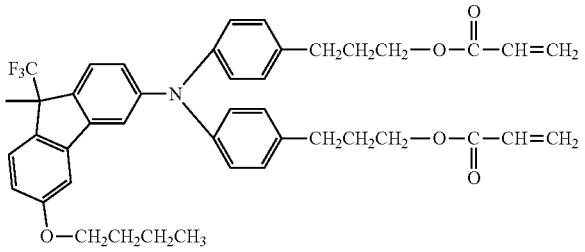
[Exemplary Compound No. 33]
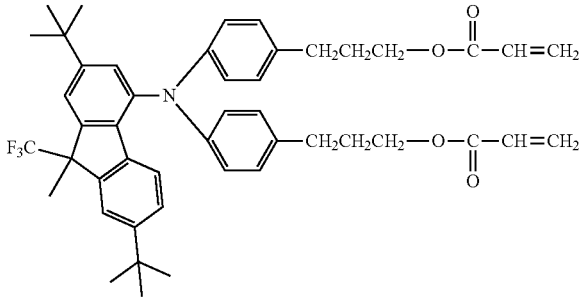
[Exemplary Compound No. 34]
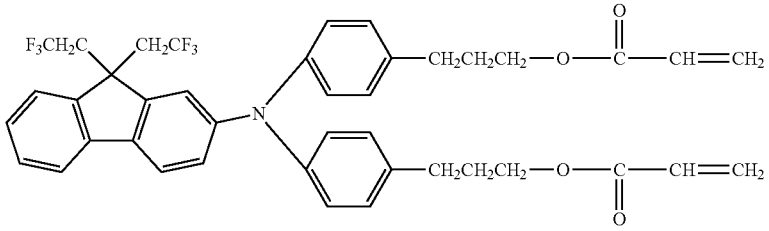

-continued
[Exemplary Compound No. 35]
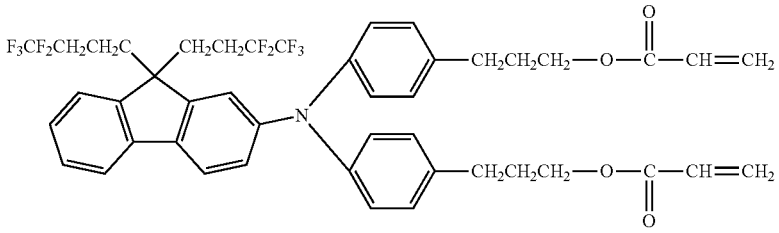
[Exemplary Compound No. 36]
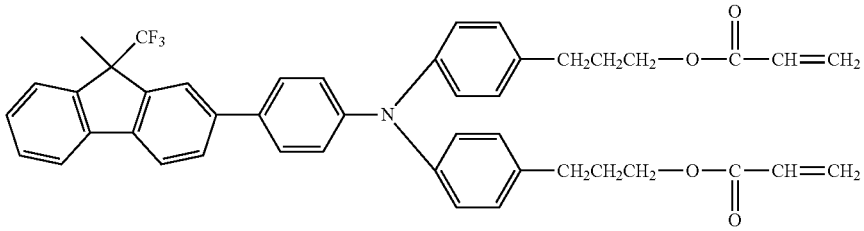
[Exemplary Compound No. 37]
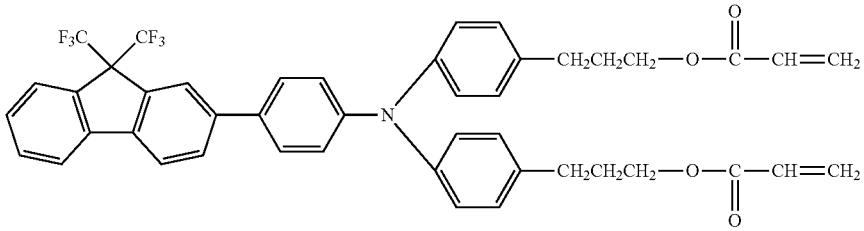
[Exemplary Compound No. 38]
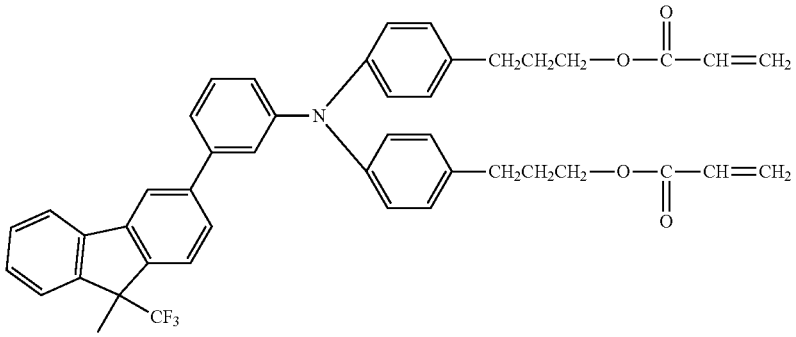
[Exemplary Compound No. 39]
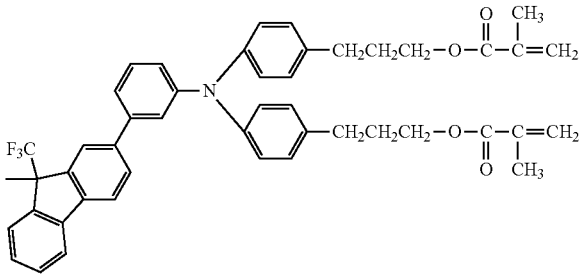
[Exemplary Compound No. 40]
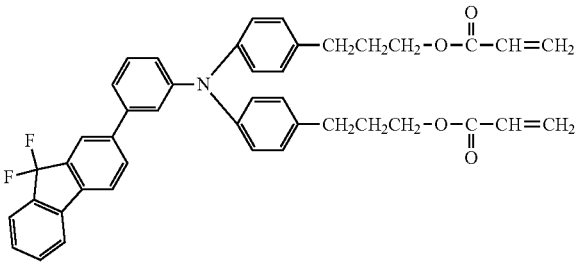
[Exemplary Compound No. 41]
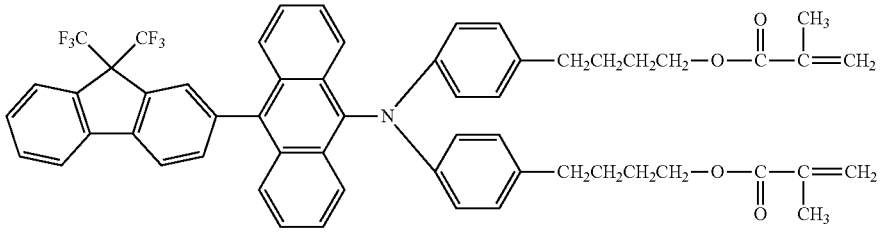

-continued
[Exemplary Compound No. 42]
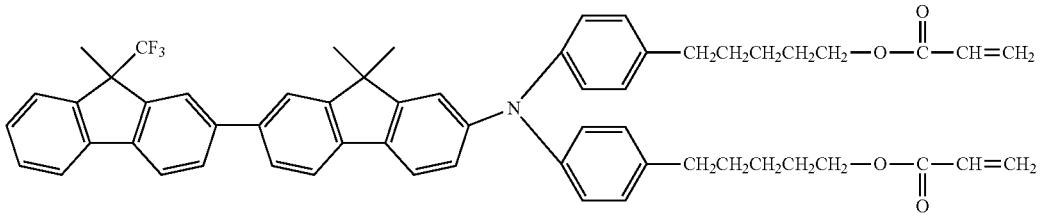
[Exemplary Compound No. 43]
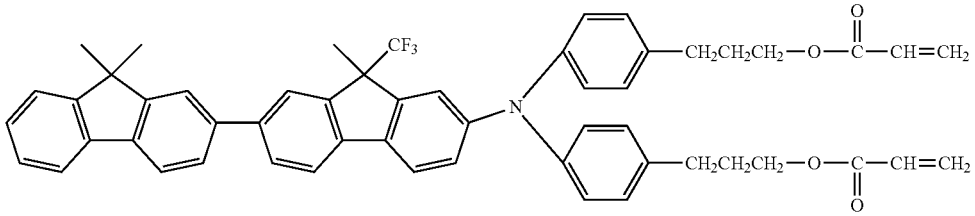
[Exemplary Compound No. 44]
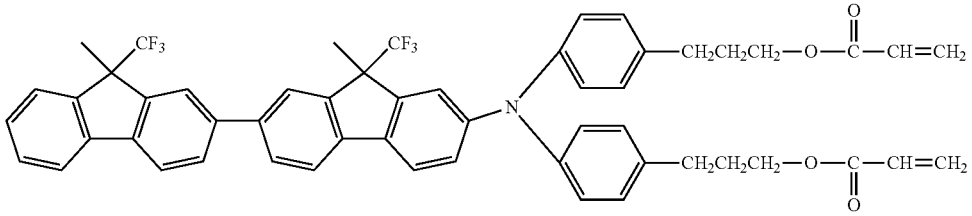
[Exemplary Compound No. 45]
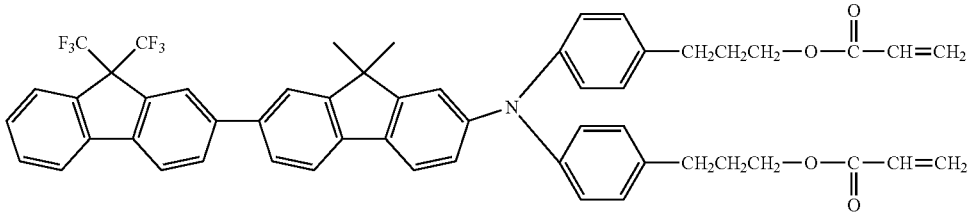
[Exemplary Compound No. 46]
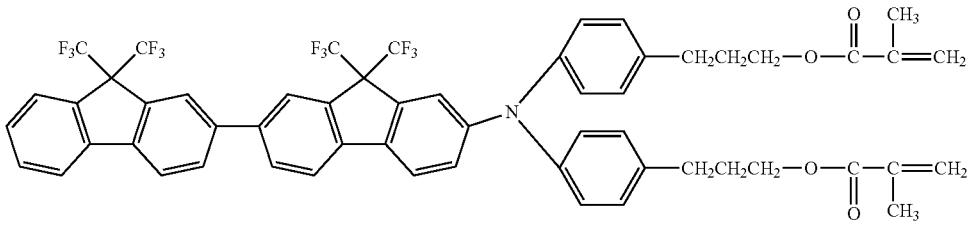
[Exemplary Compound No. 47]
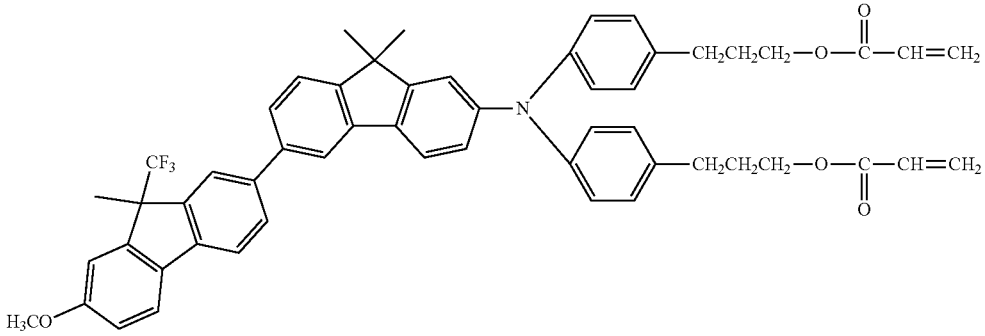

-continued
[Exemplary Compound No. 48]
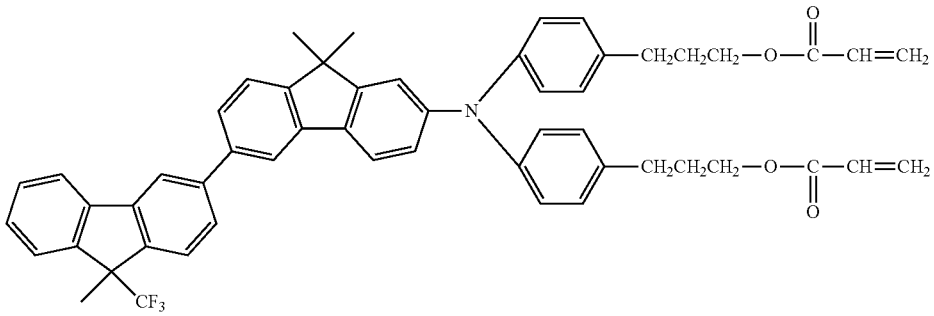
[Exemplary Compound No. 49]
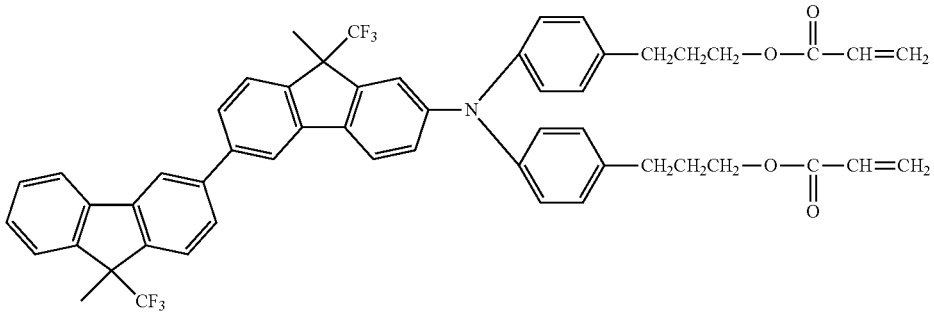
[Exemplary Compound No. 50]
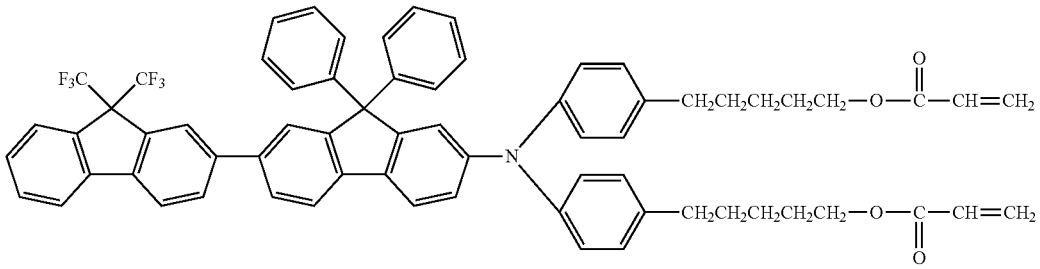
[Exemplary Compound No. 51]
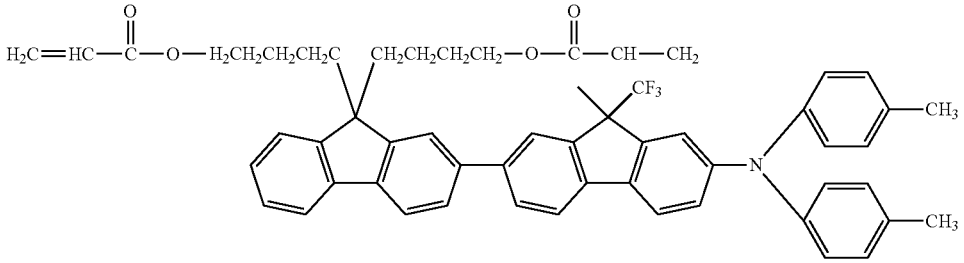
[Exemplary Compound No. 52]
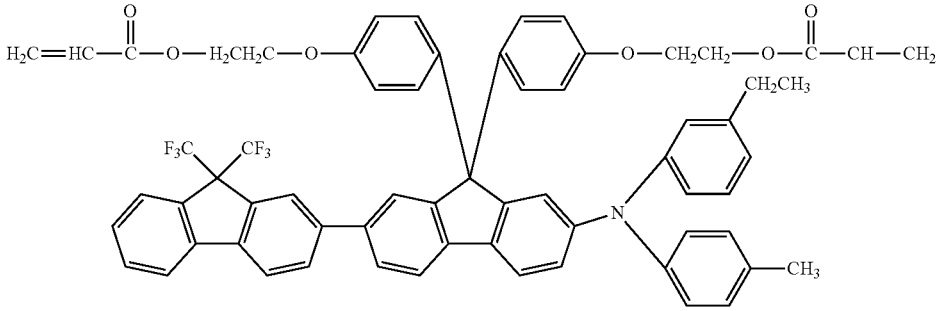

-continued
[Exemplary Compound No. 53]
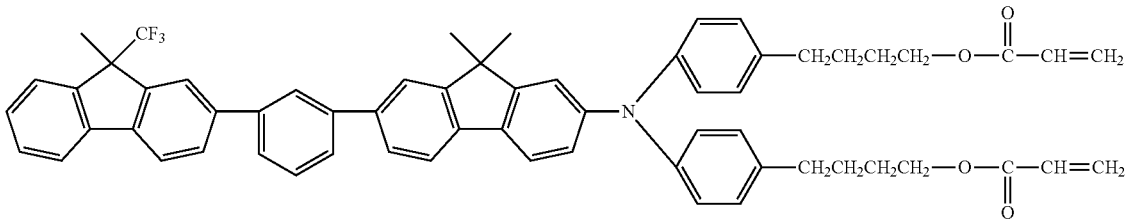
[Exemplary Compound No. 54]
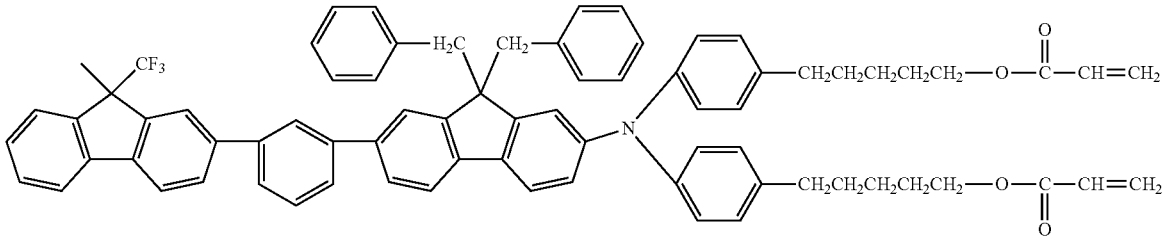
[Exemplary Compound No. 55]
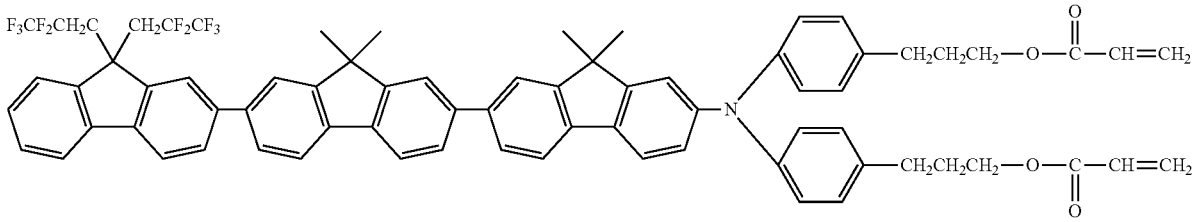
[Exemplary Compound No. 56]
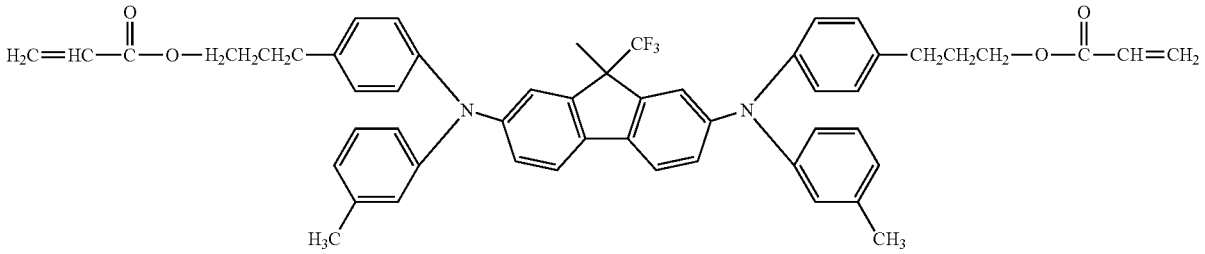
[Exemplary Compound No. 57]
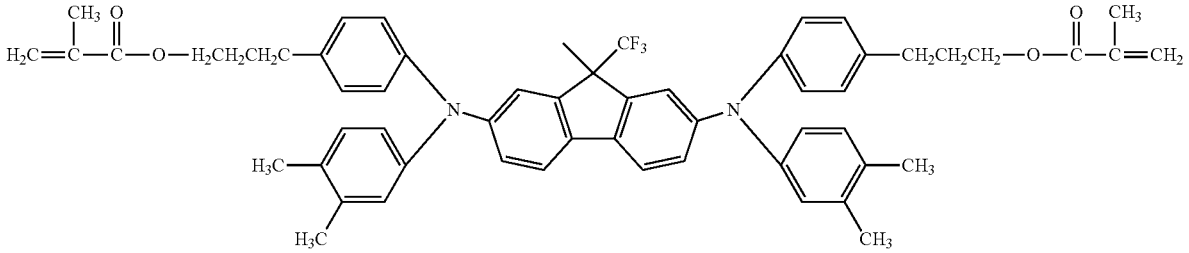
[Exemplary Compound No. 58]
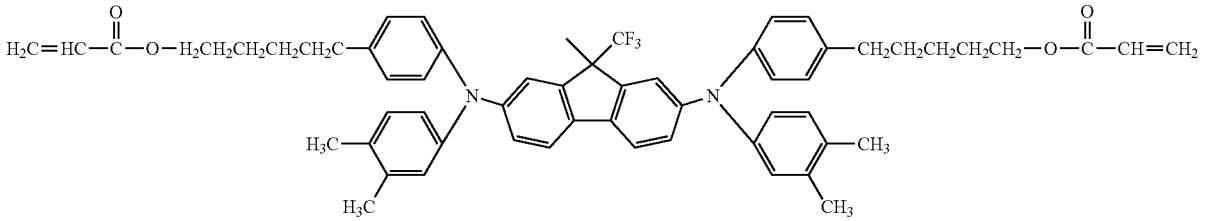

-continued
[Exemplary Compound No. 59]
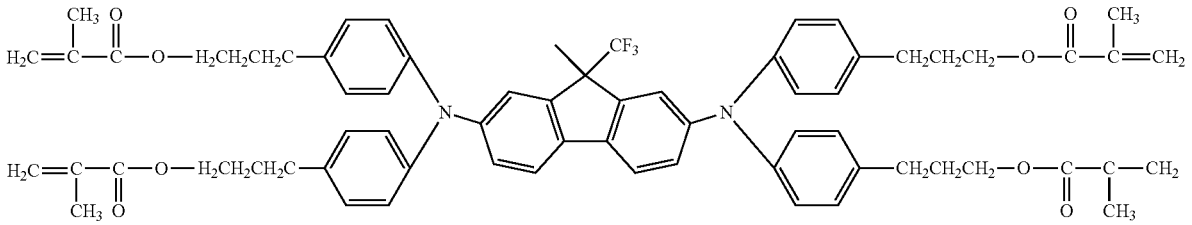
[Exemplary Compound No. 60]
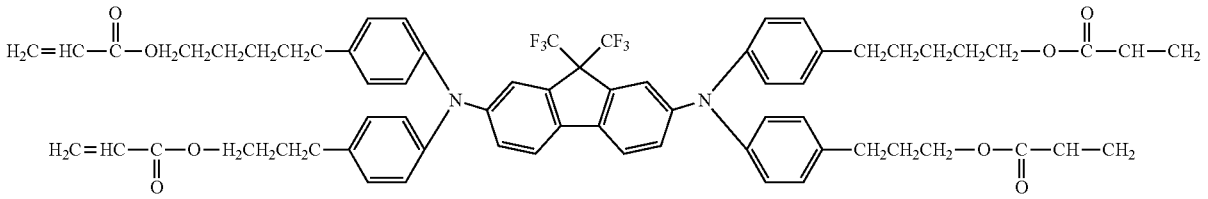
[Exemplary Compound No. 61]
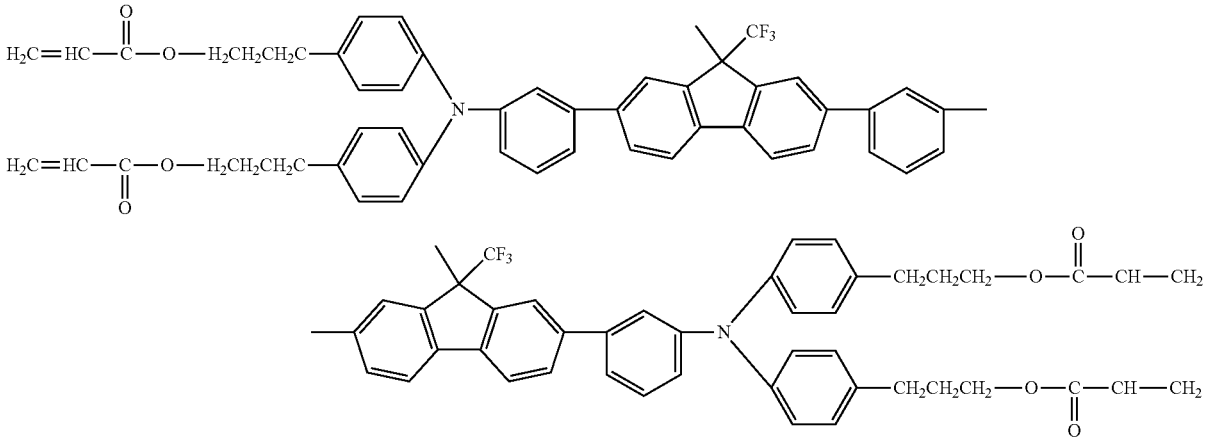
[Exemplary Compound No. 62]
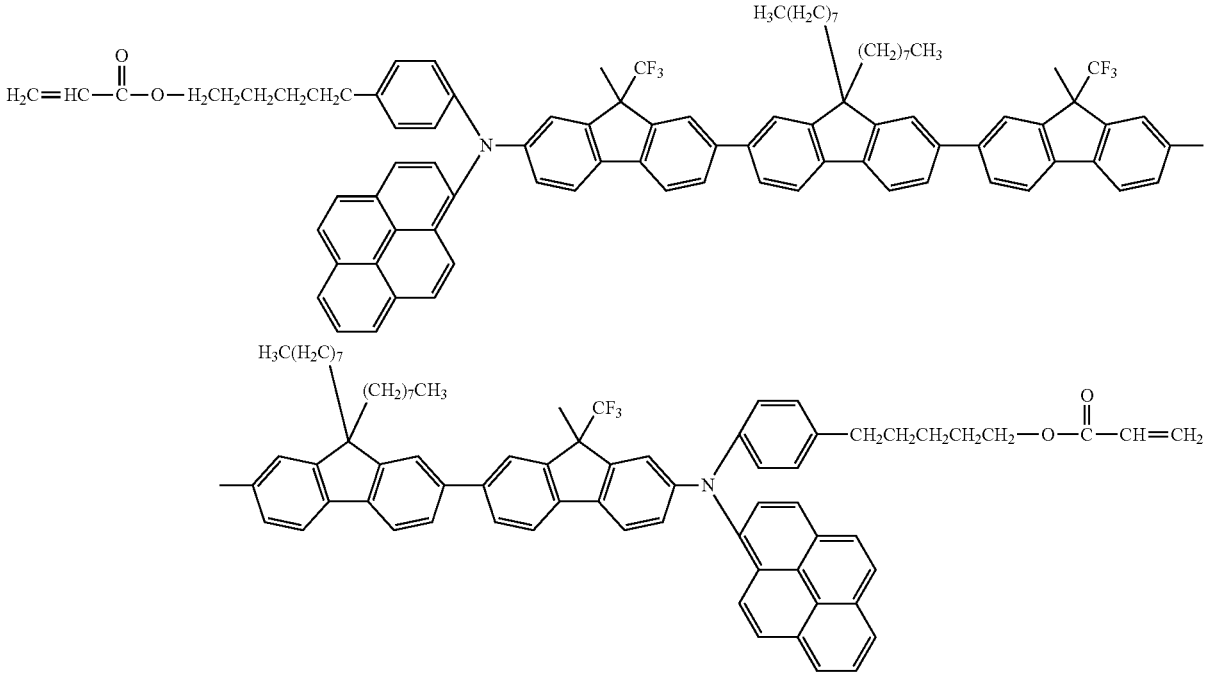

-continued
[Exemplary Compound No. 63]
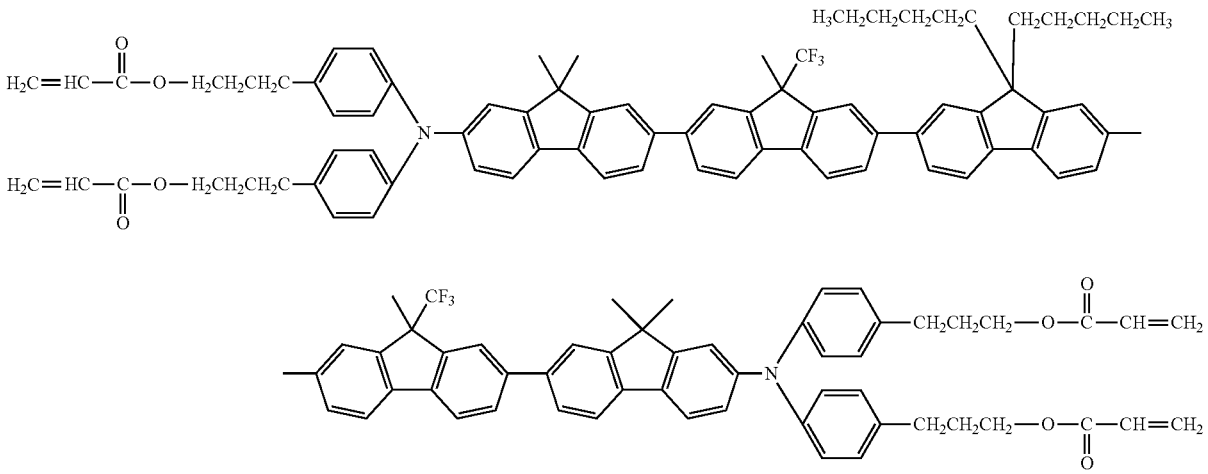
[Exemplary Compound No. 64]
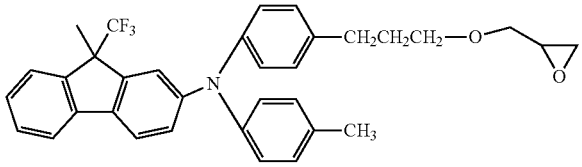
[Exemplary Compound No. 65]
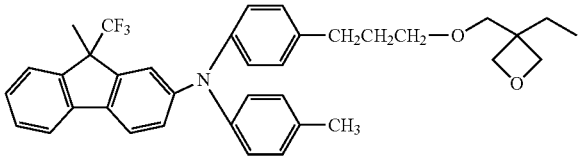
[Exemplary Compound No. 66]
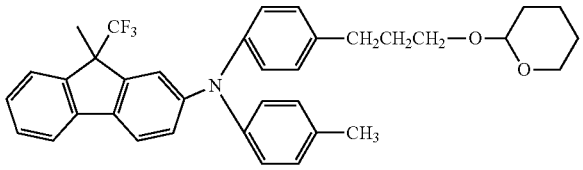
[Exemplary Compound No. 67]
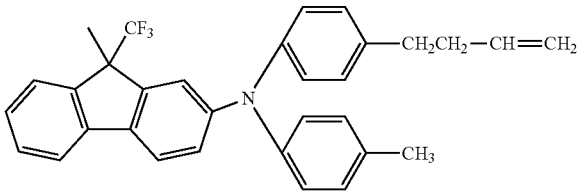
[Exemplary Compound No. 68]
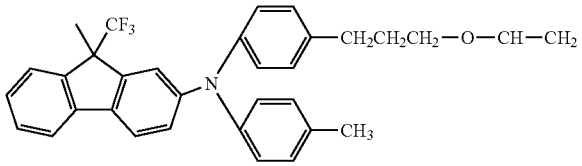
[Exemplary Compound No. 69]
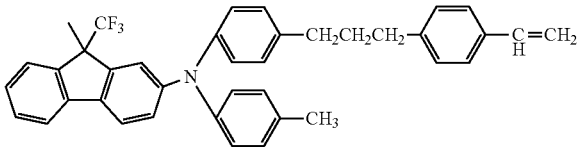
[Exemplary Compound No. 70]
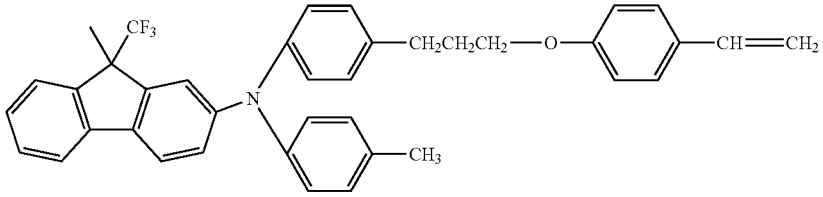
[Exemplary Compound No. 71]
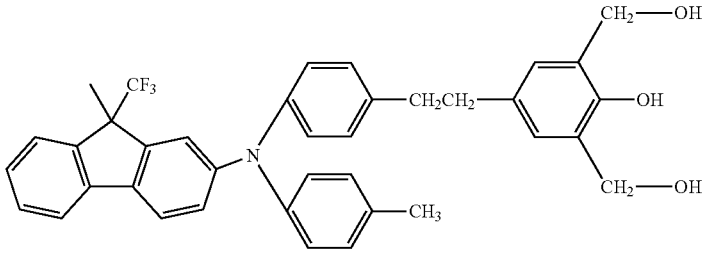

A representative synthesis example of a hole transport material according to the present invention is shown below. Further, in the synthesis example, the number of parts is in parts by mass.

Synthesis Example 1

9-methyl-9-trifluoromethyl-fluorene can be synthesized by a method described in Japanese Patent Application Laid-Open No. 2007-204425. A synthesis example of a charge transport material having a bifunctional polymerizable acrylic group represented by Exemplary Compound No. 16 is shown.

[Reaction Scheme (1)]

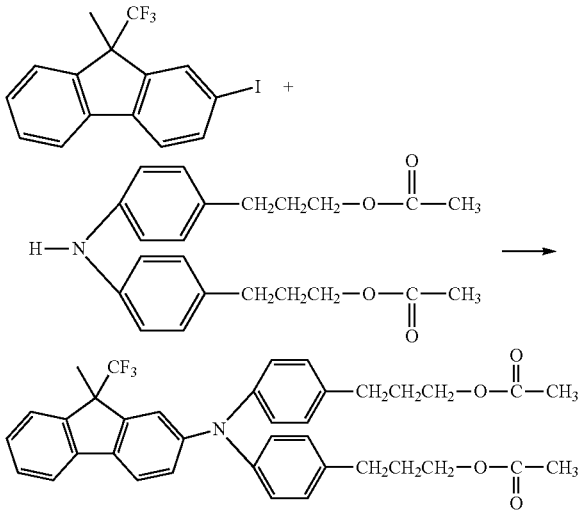

Triarylamine was synthesized as shown in Reaction Scheme (1) using an iodide and a secondary amine compound. Iodide (60 parts), 65.2 parts of a secondary amine in the formula, and 210 parts of o-dichlorobenzene were mixed in a reaction vessel, and 33.3 parts of potassium carbonate and 9.0 parts of copper powder were added. Thereafter, the reaction was performed by stirring at an internal temperature of about 190° C. for about 20 hours. After the reaction, filtration, washing with toluene, and concentration were performed to obtain a crude product.

Subsequently, as shown in Reaction Scheme (2), the obtained intermediate was hydrolyzed to form a hydroxyl group from an acetic acid ester. Tetrahydrofuran (210 parts), 80 parts of methanol, and 240 parts of a 24% aqueous sodium hydroxide solution were mixed, heated and stirred to an internal temperature of 70° C., and reacted for 2 hours to perform hydrolysis. After the reaction, the reaction mixture was extracted with ethyl acetate, and the organic layer was washed with water and brine, dehydrated, and concentrated. The obtained product was purified by silica gel chromatography to obtain a dihydroxy intermediate. The amount obtained was 53.7 parts and yield (2 steps) was 63%.

[Reaction Scheme (3)]

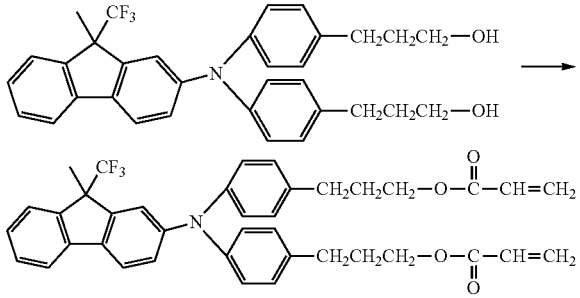

The dihydroxy intermediate (50.0 parts) obtained by the reaction shown in Reaction Scheme (2) above, 450 parts of dry tetrahydrofuran, and 23.8 parts of triethylamine were mixed, and the reactor was cooled to keep the internal temperature at 5° C. or less. While stirring, 18.7 parts of acrylonitrile chloride was slowly added dropwise for about 30 minutes, and dropping and stirring were continued while keeping the internal temperature at 10° C. or less. Thereafter, the temperature was returned to room temperature, and the reaction was continued for 2 hours to complete the reaction shown in Reaction Scheme (3).

After the reaction, the mixture was poured into 1100 parts of a 5% aqueous sodium hydroxide solution that was cooled, and extraction was performed with ethyl acetate. Water washing, dehydration, and concentration were performed to obtain a crude product.

Subsequently, the crude product was purified by silica gel column chromatography to obtain a hole transport material

[Reaction Scheme (2)]

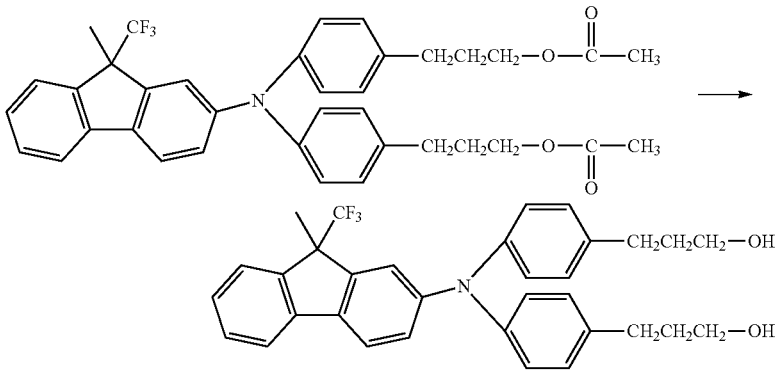

having a polymerizable functional group. The amount obtained was 30.8 parts and yield was 51.2%.

In addition, varnish can be obtained by adjusting a type and an amount of a solvent to be mixed with the obtained hole transport material.

Further, the hole transport material having the polymerizable functional group according to the present invention and a hole transport material having a known polymerizable functional group may be contained together in the range at which effects of the present invention are not hindered. As the hole transport material having the known polymerizable functional group, an aromatic amine compound may be used.

A surface layer of an electrophotographic photosensitive member according to an embodiment of the present invention can contain a polymer of a mixed composition including a hole transport material having a polymerizable functional group according to the present invention and other compounds having the polymerizable functional group and having no hole transport property. By using a material having a different polymerizable functional group together, mechanical strength of a polymer to be obtained can be further improved. More preferably, the hole transport material according to the present invention has one or more polymerizable functional groups and the compound having no hole transport property has two or more polymerizable functional groups.

The polymerizable functional group contained in the compound having the polymerizable functional group and having no hole transport property may be the above-described polymerizable functional group. Preferably, a radically polymerizable functional group such as a styryl group, a vinyl group, an acryloyloxy group, a methacryloyloxy group, or the like, is preferred. Even more preferably, the acryloyloxy group or the methacryloyloxy group is preferred.

A monofunctional group to be described below means to have one polymerizable functional group.

Examples of the compound having a polymerizable functional group and having no hole transport structure may include the following examples. An example having an acryloyloxy group as the polymerizable functional group is shown below.

As a monofunctional polymerizable monomer, for example, ethyl acrylate, n-propyl acrylate, n-butyl acrylate, isobutyl acrylate, 2-ethylhexyl acrylate, 2-hydroxyethyl acrylate, tetrahydrofurfuryl acrylate, benzyl acrylate, cyclohexyl acrylate, ethoxy-diethylene glycol acrylate, isoamyl acrylate, lauryl acrylate, stearyl acrylate, phenoxyethyl acrylate, phenoxy diethylene glycol acrylate, ethoxylated o-phenylphenol acrylate, and the like, may be included.

As a bifunctional polymerizable monomer, 1,4-butanediol diacrylate, 1,5-pentanediol diacrylate, 3-methyl-1,5-pentanediol diacrylate, 1,6-hexanediol diacrylate, 1,9-nonanediol diacrylate, 1,10-decanediol diacrylate, triethylene glycol diacrylate, neopentyl glycol diacrylate, tricyclodecane dimethanol diacrylate, and the like, may be included.

As a trifunctional polymerizable monomer, trimethylol propane triacrylate, pentaerythritol triacrylate, ethoxylated isocyanuric acid triacrylate, and the like, may be included.

As a tetrafunctional polymerizable monomer, pentaerythritol tetraacrylate, dimethylol propane tetraacrylate, and the like, may be included.

As a hexafunctional polymerizable monomer, for example, dipentaerythritol hexaacrylate, and the like, may be included.

As described above, even though an acrylate monomer is exemplified, a compound having a polymerizable functional group synthesized by substituting an acryloyloxy group with a methacryloyloxy group or other polymerizable functional groups may be used as needed.

A surface layer may contain various fine particles in view of abrasion resistance. The fine particles may be inorganic fine particles or organic fine particles. As the inorganic fine particles, particles containing alumina, silica, zinc oxide, tin oxide, titanium oxide, and the like, are used.

As the organic fine particles, various organic resin fine particles can be used. A polyolefin resin, a polytetrafluoroethylene resin, a polystyrene resin, a polyacrylic ester resin, a polymethacrylic acid ester resin, a polyamide resin, a polyester resin, a polyurethane resin, and the like, may be used.

The surface layer can be formed by forming a coating film of a coating liquid for a surface layer containing the hole transport material according to the present invention, and drying and/or curing the coating film.

Examples of a solvent used for the coating liquid for the surface layer can include alcohol solvents, sulfoxide-based solvents, ketone-based solvents, ether-based solvents, ester-based solvents, aliphatic halogenated hydrocarbon-based solvents, aliphatic hydrocarbon-based solvents, aromatic hydrocarbon-based solvents, and the like.

When the surface layer is a protection layer, a thickness of the surface layer is preferably 0.1 μm or more to 15 μm or less. When the surface layer is a charge transport layer, a thickness of the surface layer is preferably 5 μm or more to 40 μm or less.

As a method of curing the coating film of the coating liquid for the surface layer (a method of polymerizing the hole transport material according to the present invention), a method of polymerizing by using heat, light (ultraviolet ray, etc.), or radiation (electron beam, etc.), may be included. Among them, radiation is preferred, and electron beam is more preferred among radiations.

It is preferred that when polymerization is performed by using an electron beam, a highly dense (high-density) three-dimensional network structure can be obtained to improve abrasion resistance. In addition, since an efficient polymerization reaction in a short time may be performed, productivity also increases. When emitting an electron beam, examples of an accelerator may include a scanning type, an electro-curtain type, a broad beam type, a pulse type, a lamina type, and the like.

When using the electron beam, an acceleration voltage of the electron beam is preferably 150 kV or less from the viewpoint of suppressing deterioration of material characteristics due to the electron beam without deteriorating polymerization efficiency. In addition, an electron beam absorption amount on a surface of the coating film of the coating liquid for the surface layer is preferably 1 kGy or more to 50 kGy or less, and more preferably 5 kGy or more to 10 kGy or less.

Further, when polymerizing the hole transport material according to the present invention using an electron beam, it is preferable to emit an electron beam in an inert gas atmosphere and then heat in an inert gas atmosphere for the purpose of suppressing a polymerization inhibiting action by oxygen. Examples of the inert gas may include nitrogen, argon, helium, and the like.

Next, an entire constitution of the electrophotographic photosensitive member of the present invention is described.

<Electrophotographic Photosensitive Member>

A preferable constitution of the electrophotographic photosensitive member in the present invention is a structure in which a charge generation layer and a hole transport layer are subsequently stacked on a support. If necessary, a conductive layer or an undercoat layer may be provided between the charge generation layer and the support, and a protection layer may be provided on the hole transport layer. Further, in the present invention, the charge generation layer and the hole transport layer are also referred to as a photosensitive layer.

The hole transport material according to the present invention is contained in the surface layer. The surface layer in the present invention refers to the protection layer when the protection layer is provided on the electrophotographic photosensitive member, and refers to the hole transport layer when no protection layer is provided. Further, the photosensitive layer may be formed of a single layer type photosensitive layer containing a charge generating substance and a hole transport material.

<Support>

A support used in the present invention is preferably a conductive support formed of a conductive material. Examples of a material of the support may include metals or alloys such as iron, copper, gold, silver, aluminum, zinc, titanium, lead, nickel, tin, antimony, indium, chromium, aluminum alloy, stainless steel, and the like. A metal support or a resin support having a coating film formed by vacuum evaporation of aluminum, an aluminum alloy, an indium oxide-tin oxide alloy, or the like, can also be used. Further, a support obtained by dipping conductive particles such as carbon black, tin oxide particles, titanium oxide particles, or silver particles into plastic or paper, or a support containing a conductive resin can be used. Examples of a shape of the support may include a cylindrical shape, a belt shape, a sheet shape, a plate shape, and the like, but the cylindrical shape is most common.

A surface of the support may be subjected to treatment such as cutting treatment, roughening treatment, alumite treatment, or the like, from the viewpoints of suppressing interference fringes due to scattering of laser light, improving surface defects of the support, and improving conductivity of the support, and the like.

A conductive layer may be provided between the support and an undercoat layer or a charge generation layer to be described below for the purpose of suppressing interference fringes due to scattering of a laser, or the like, controlling resistance, or covering flaws in the support.

The conductive layer can be formed by applying a coating liquid for a conductive layer obtained by dispersing carbon black, a conductive pigment, a resistance-controlling pigment, or the like together with a binder resin, and drying the obtained coating film. To the coating liquid for a conductive layer, a compound to be cured and polymerized by heating, irradiation with ultraviolet rays, irradiation with radiation, or the like, may be added. The conductive layer formed by dispersing the conductive pigment or the resistance-controlling pigment tends to have its surface roughened.

A thickness of the conductive layer is preferably 0.1 μm or more to 50 μm or less, more preferably 0.5 μm or more to 40 μm or less, and even more preferably 1 μm or more to 30 μm or less.

Examples of a binder resin used for the conductive layer may include a polymer and a copolymer of a vinyl compound such as styrene, vinyl acetate, vinyl chloride, acrylic acid ester, methacrylic acid ester, vinylidene fluoride, trifluoroethylene, or the like, a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, an epoxy resin, and an isocyanate resin.

Examples of the conductive pigment and the resistance-controlling pigment may include particles of metals (alloys) such as aluminum, zinc, copper, chromium, nickel, silver, stainless steel, and the like, or pigment obtained by depositing the particles on surfaces of plastic particles. Further, the particle may be a particle of a metal oxide such as zinc oxide, titanium oxide, tin oxide, antimony oxide, indium oxide, bismuth oxide, tin-doped indium oxide, antimony or tantalum-doped tin oxide, and the like. The particle may be used alone, or in combination of two or more thereof.

An undercoat layer (intermediate layer) may be provided between the support or the conductive layer and the charge generation layer for the purpose of improving adhesiveness of the charge generation layer, improving a hole injection property from the support, and protecting the charge generation layer from electrical breakdown, and the like.

The undercoat layer can be formed by applying a coating liquid for an undercoat layer obtained by dissolving the binder resin in a solvent, and drying the obtained coating film.

Examples of the binder resin used for the undercoat layer may include a polyvinyl alcohol resin, poly-N-vinylimidazole, a polyethylene oxide resin, ethylcellulose, an ethylene-acrylic acid copolymer, casein, a polyamide resin, an N-methoxymethylated 6-nylon resin, a copolymer nylon resin, a phenol resin, a polyurethane resin, an epoxy resin, an acrylic resin, a melamine resin, a polyester resin, and the like.

The undercoat layer may further contain metal oxide particles. Examples of the metal oxide particles may include particles containing titanium oxide, zinc oxide, tin oxide, zirconium oxide, and aluminum oxide. In addition, the metal oxide particles may be metal oxide particles in which a surface of the metal oxide particles is treated with a surface treatment agent such as a silane coupling agent, or the like.

A thickness of the undercoat layer is preferably 0.05 μm or more to 30 μm or less, and more preferably 1 μm or more to 25 μm or less. The undercoat layer may further contain organic resin fine particles, and a leveling agent.

Next, the charge generation layer is described. The charge generation layer can be formed by applying a coating liquid for a charge generation layer obtained by dispersing a charge generating substance together with a binder resin and a solvent to form a coating film, and drying the obtained coating film. Further, the charge generation layer may be a vapor deposition film of a charge generating substance.

Examples of the charge generating substance used in the charge generation layer may include azo pigments, phthalocyanine pigments, indigo pigments, perylene pigments, polycyclic quinone pigments, squarylium pigments, pyrylium salt, thiapyrylium salt, triphenylmethane dyes, quinacridone pigments, azulenium salt pigments, cyanine dyes, anthanthrone pigments, pyranthrone pigments, xanthene dyes, quinone imine dyes, styryl dyes, and the like. These charge generating substances may be used alone or in combination of two or more thereof. Among these charge generating substances, phthalocyanine pigments or azo pigments are preferred from the viewpoint of sensitivity, and particularly, the phthalocyanine pigments are more preferred.

Among the phthalocyanine pigments, oxytitanium phthalocyanine, chlorogallium phthalocyanine, and hydroxy gallium phthalocyanine particularly exhibit excellent charge generation efficiency. Further, among the hydroxygallium phthalocyanines, from the viewpoint of sensitivity, a crystalline hydroxygallium phthalocyanine crystal in which Bragg angle 2θ has peaks at 7.4°±0.3° and 28.2°±0.3° in CuKα characteristic X-ray diffraction is more preferred.

Examples of a binder resin used for the charge generation layer may include a polymer of a vinyl compound such as styrene, vinyl acetate, vinyl chloride, acrylic acid ester, methacrylic acid ester, vinylidene fluoride, trifluoroethylene, or the like, a polyvinyl alcohol resin, a polyvinyl acetal resin, a polycarbonate resin, a polyester resin, a polysulfone resin, a polyphenylene oxide resin, a polyurethane resin, a cellulose resin, a phenol resin, a melamine resin, a silicon resin, and an epoxy resin.

A mass ratio between the charge generating substance and the binder resin is preferably 1:0.3 to 1:4.

A thickness of the charge generation layer is preferably 0.05 μm or more to 1 μm or less, and more preferably 0.1 μm or more to 0.5 μm or less.

Next, a hole transport layer is described. When the hole transport layer is a surface layer, as described above, the hole transport layer contains a polymer of a hole transport material according to the present invention.

Meanwhile, when a protection layer is provided on the hole transport layer, the hole transport layer can be formed by forming a coating film of a coating liquid for a hole transport layer in which the hole transport material and a binder resin are mixed in a solvent, and drying the coating film. Hereinafter, the hole transport material and the binder resin used in the hole transport layer are described.

Examples of the hole transport material may include a carbazole compound, a hydrazone compound, an N,N-dialkyl aniline compound, a diphenylamine compound, a triphenylamine compound, a triphenylmethane compound, a pyrazoline compound, a styryl compound, a stilbene compound, and the like.

Examples of the binder resin may include an acrylic acid ester, a methacrylic acid ester, a polyvinyl alcohol resin, a polyvinyl acetal resin, a polycarbonate resin, a polyester resin, and the like. Further, a curable resin such as a curing type phenol resin, a curing type urethane resin, a curing type melamine resin, a curing type epoxy resin, a curing type acrylic resin, a curing type methacrylic resin, or the like, can be used.

Examples of a solvent used for the coating liquid for a hole transport layer may include alcohol solvents, sulfoxide-based solvents, ketone-based solvents, ether-based solvents, ester-based solvents, aliphatic halogenated hydrocarbon-based solvents, and aromatic hydrocarbon-based solvents, and the like.

A thickness of the hole transport layer is preferably 1 μm or more to 100 μm or less, more preferably 3 μm or more to 50 μm or less, and further preferably 5 μm or more to 40 μm or less.

Various additives can be added to each layer of the electrophotographic photosensitive member of the present invention. Specific examples may include organic pigments, organic dyes, coating film surface conditioners, electron transport agents, oils, waxes, antioxidants, light absorbers, polymerization initiators, radical deactivating agents, organic resin fine particles, inorganic particles, and the like.

A surface of each layer of the electrophotographic photosensitive member may be surface-treated by using a polishing sheet, a shape transfer member, glass beads, zirconium oxide beads, or the like. In addition, irregularities may be formed on a surface by using a constituent material of the coating liquid. When the coating liquid of each layer is applied, for example, any known coating methods such as a dipping coating method, a spray coating method, a circulation volume type (ring) coating method, a spin coating method, a roller coating method, a Meyer bar coating method, and a blade coating method can be used.

Next, a process cartridge provided with the electrophotographic photosensitive member according to an embodiment of the present invention and an image forming process are described.

The process cartridge including the electrophotographic photosensitive member according to an embodiment of the present invention is characterized by including at least one unit selected from a charging unit, a developing unit, and a cleaning unit that is integrally supported and being detachably attachable to an electrophotographic apparatus main body.

FIG. 1 shows an example of a constitution of a process cartridge according to an embodiment of the present invention. In FIG. 1, a cylindrical electrophotographic photosensitive member 1 is rotationally driven at a predetermined peripheral speed in a direction of an arrow. A peripheral surface of the electrophotographic photosensitive member 1 to be rotationally driven is uniformly charged to a predetermined positive or negative potential by the charging unit 2. Subsequently, the peripheral surface of the charged electrophotographic photosensitive member 1 receives exposure light (image exposure light) 3 output from an exposing unit (not shown) such as slit exposure, laser beam scanning exposure, or the like. Thus, an electrostatic latent image corresponding to a target image is sequentially formed on the peripheral surface of the electrophotographic photosensitive member 1. A voltage applied to the charging unit (charging roller, or the like) 2 may be either a voltage obtained by superimposing an AC component on a DC component or a voltage only on a DC component.

The electrostatic latent image formed on the peripheral surface of the electrophotographic photosensitive member 1 is then developed by a toner included in a developer of a developing unit 4 to become a toner image. Then, the toner image formed and supported on the peripheral surface of the electrophotographic photosensitive member 1 is sequentially transferred from a transfer unit (a transfer roller, or the like) 5 to a transfer material (paper, an intermediate transfer member, or the like) 6 by a transfer bias. The transfer material 6 is fed in synchronization with rotation of the electrophotographic photosensitive member 1.

The surface of the electrophotographic photosensitive member 1 after transferring the toner image is subjected to charge elimination treatment by a pre-exposure light 7 from a pre-exposing unit (not shown), and then a transfer residual toner is removed by a cleaning unit 8 to form a clean surface, and the electrophotographic photosensitive member 1 is repeatedly used for image formation. In addition, the pre-exposing unit may be used before or after the cleaning process, and the pre-exposing unit is not necessarily required.

The electrophotographic photosensitive member 1 may be mounted in an electrophotographic apparatus such as a copying machine, a laser beam printer, or the like. Further, a process cartridge 9 having a plurality of components such as the electrophotographic photosensitive member 1, the charging unit 2, the developing unit 4, the cleaning unit 8, and the like, in a container so as to be integrally supported may be constituted so as to be detachably attachable to an electrophotographic apparatus main body. FIG. 1 shows the process cartridge 9 including the electrophotographic photosensitive member 1, the charging unit 2, the developing unit 4, and the cleaning unit 8 that are integrally supported, and being detachably attachable to the electrophotographic apparatus main body.

Next, an electrophotographic apparatus including an electrophotographic photosensitive member according to an embodiment of the present invention is described. The electrophotographic apparatus including an electrophotographic photosensitive member according to an embodiment of the present invention is characterized by including at least one unit selected from a charging unit, an exposing unit, a developing unit, a transfer unit, and a cleaning unit.

Figure 2:
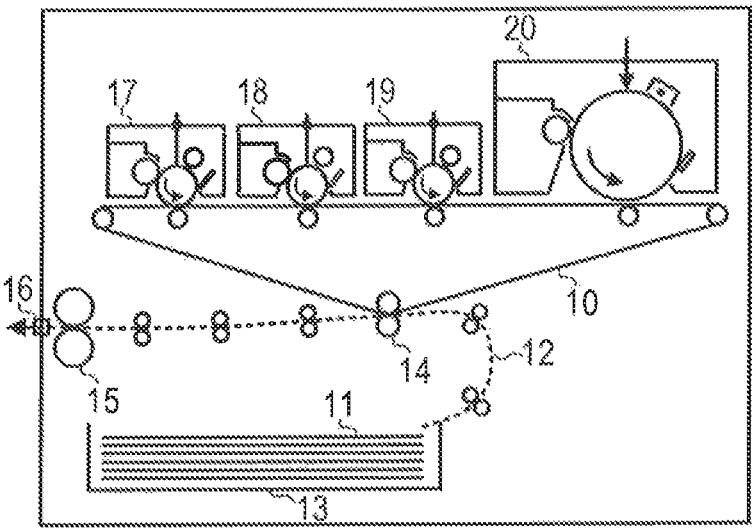
FIG. 2 is a schematic view showing an example of an electrophotographic apparatus including an electrophotographic photosensitive member according to an embodiment of the present invention.

An example of a constitution of the electrophotographic apparatus of the present invention is shown in FIG. 2. A process cartridge 17 for yellow color, a process cartridge 18 for magenta color, a process cartridge 19 for cyan color, and a process cartridge 20 for black color corresponding to respective colors of yellow, magenta, cyan, and black are positioned along an intermediate transfer member 10. As shown in FIG. 2, a diameter of the electrophotographic photosensitive member, a constituent material, a developer, a charging method, and other unit are not necessarily unified for each color. For example, in the electrophotographic apparatus of FIG. 2, the diameter of the electrophotographic photosensitive member in the black color is larger than that of other colors (yellow, magenta, and cyan). In addition, when a charging method of color is a method of applying a voltage in which an AC component is superimposed on a DC component, in the black color, a method of using a corona discharge is adopted.

When an image forming operation is started, the toner images of the respective colors are sequentially superimposed on an intermediate transfer member 10 according to the above-described image forming process. Together with this, a transfer sheet 11 is fed out from a paper feed tray 13 by a paper feed path 12 and fed to a secondary transfer unit 14 in synchronism with a rotation operation of the intermediate transfer member. The toner image on the intermediate transfer member 10 is transferred to the transfer sheet 11 by the transfer bias from the secondary transfer unit 14. The toner image transferred onto the transfer paper 11 is conveyed along a paper feeding path 12 and fixed on the transfer paper by a fixing unit 15 and delivered from a paper delivery part 16.

Further, a method of manufacturing an electrophotographic photosensitive member according to an embodiment of the present invention is a method of manufacturing an electrophotographic photosensitive member having a support and a photosensitive layer on the support. The above-described manufacturing method includes forming a coating film of a coating liquid for a surface layer containing a hole transport compound represented by Formula (1), and polymerizing the hole transport compound represented by Formula (1) in the coating film, thereby forming the surface layer of the electrophotographic photosensitive member.

According to one aspect of the present invention, there is provided an electrophotographic photosensitive member in which abrasion resistance is high, image flow is effectively suppressed, and potential variation when repeatedly used under a low humidity environment is suppressed. Further, according to one aspect of the present invention, there is provided an electrophotographic apparatus including the electrophotographic photosensitive member. Further, according to one aspect of the present invention, there is provided a process cartridge including the electrophotographic photosensitive member.

EXAMPLE

Hereinafter, the present invention is described in more detail with reference to Examples. In the Examples, a 'part' means a 'mass part'. Further, the electrophotographic photosensitive member is also simply referred to as a 'photosensitive member'.

<Manufacture of Electrophotographic Photosensitive Member>

Example 1

A cylindrical aluminum cylinder having an outer diameter of 30.0 mm, a length of 357.5 mm and a thickness of 0.7 mm was used as a support (conductive support).

Thereafter, 10 parts of zinc oxide particles (specific surface area: 19 $m^2/g$, powder resistivity: $4.7\times10^6\cdot\Omega\cdot cm$) were mixed with stirring with 50 parts of toluene, and 0.08 parts of a silane coupling agent (product name: KBM602 manufactured by Shin-Etsu Chemical Co., Ltd., compound name: N-2-(aminoethyl)-3-aminopropylmethyldimethoxysilane, was added thereto and stirred for 6 hours. Thereafter, toluene was subjected to distillation under reduced pressure and then dried by heating at 130° C. for 6 hours to obtain surface-treated zinc oxide particles.

Thereafter, 15 parts of a polyvinyl butyral resin (weight average molecular weight: 40000, product name: BM-1 manufactured by Sekisui Chemical Company, Limited) and 15 parts of blocked isocyanate (product name: DURANATE TPA-B80E manufactured by Asahi Kasei Chemicals Corporation) were dissolved in a mixed solution of 73.5 parts of methyl ethyl ketone and 73.5 parts of 1-butanol. To this solution, 80.8 parts of the above surface-treated zinc oxide particles and 0.8 parts of 2,3,4-trihydroxybenzophenone (manufactured by Wako Pure Chemical Industries, Ltd.) were added and dispersed for 3 hours in a sand mill apparatus using glass beads having a diameter of 0.8 mm in an atmosphere of 23±3° C. After dispersion treatment, 0.01 parts of a silicone oil (product name: SH28PA manufactured by Dow Corning Toray Co., Ltd.) and 5.6 parts of cross-linked polymethyl methacrylate (PMMA) particles (product name: TECHPOLYMER SSX-102 manufactured by Sekisui Plastics Co., Ltd., average primary particle size: 2.5 μm) was added to the mixture and stirred to prepare a coating liquid for an undercoat layer.

The coating liquid for the undercoat layer was dipped and applied on the support to form a coating film, and the obtained coating film was dried at 160° C. for 40 minutes to form an undercoat layer having a thickness of 18 μm.

Thereafter, crystalline hydroxygallium phthalocyanine crystal (charge generating substance) in which Bragg angle 2θ±0.2° has peaks at 7.4° and 28.2° in CuKα characteristic X-ray diffraction was prepared. The hydroxygallium phthalocyanine crystal (2 parts), 0.02 parts of a calixarene compound represented by Formula (A) below, 1 part of polyvinyl butyral (product name: S-LEC BX-1 manufactured by Sekisui Chemical Co., Ltd.), and 60 parts of cyclohexanone were put in a sand mill using glass beads having a diameter of 1 mm, and dispersed for 4 hours. Thereafter, 70 parts of ethyl acetate was added to prepare a coating liquid for a charge generation layer. The coating liquid for the charge generation layer was dipped and applied on the undercoat layer, and the obtained coating film was dried at 90° C. for 15 minutes to form a charge generation layer having a thickness of 0.17 μm.

[Formula (A)]

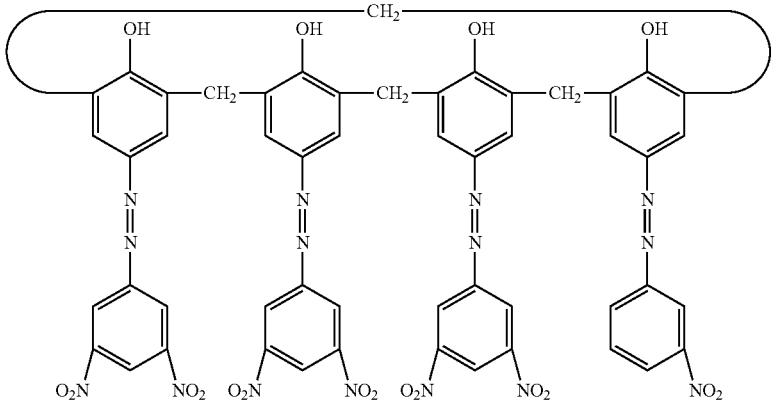

Then, 6 parts of a compound represented by Formula (B), 3 parts of a compound represented by Formula (C), 1 part of a compound represented by Formula (D), and 10 parts of a bisphenol Z type polycarbonate resin (product name: Iupilon Z400 manufactured by Mitsubishi Engineering-Plastics Corporation) were dissolved in a mixed solvent of 60 parts of monochlorobenzene and 20 parts of dimethoxy methane, thereby preparing a coating liquid for a hole transport layer. The coating liquid for the hole transport layer was dipped and applied on the charge generation layer, and the obtained coating film was dried at 100° C. for 50 minutes to form a hole transport layer having a thickness of 18 μm.

[Formula (B)]

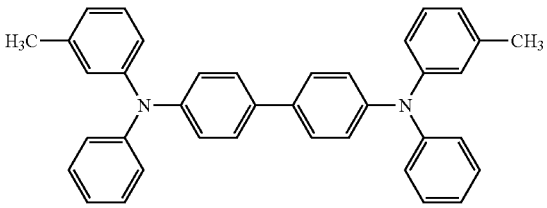

[Formula (C)]

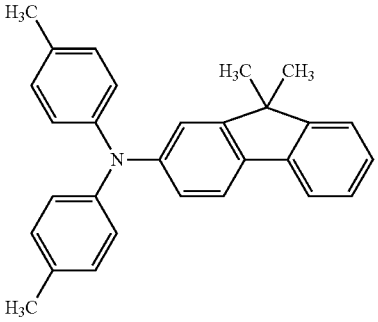

-continued

[Formula (D)]

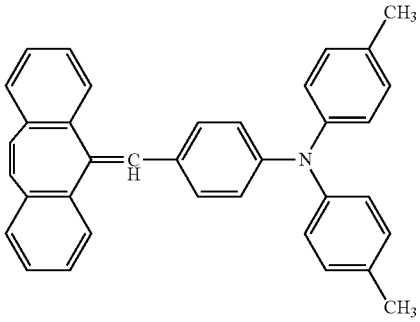

Then, 3 parts of a hole transport material represented by an Exemplary Compound No. 5 and 3 parts of a hole transport material represented by Formula (E) below were dissolved in 7 parts of 1-propanol and 7 parts of ZEORORAH (manufactured by Zeon Corporation, Japan) as solvents, thereby preparing a coating liquid for a protection layer.

[Formula (E)]

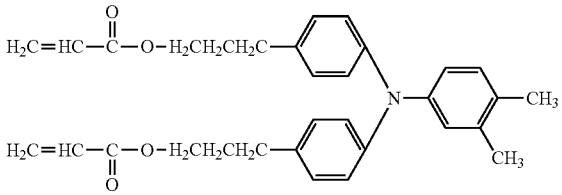

The coating liquid for the protection layer was dipped and applied on the hole transport layer, and the obtained coating film was dried at 50° C. for 10 minutes to perform polymerization curing treatment by electron beam irradiation and heating under the following conditions.

While an aluminum cylinder was rotated at a speed of 300 rpm in an atmosphere having an oxygen concentration of 100 ppm or less, electron beam irradiation was performed under conditions of an irradiation distance of 30 mm, an acceleration voltage of 70 kV, a beam current of 7 mA, and an irradiation time of 2.4 seconds using an electron beam irradiation apparatus. After the electron beam irradiation, a surface of the coating film of the protection layer was rapidly heated to 130° C. over 20 seconds using an induction heating apparatus under condition that oxygen concentration is 100 ppm or less.

Thereafter, the aluminum cylinder was taken out of the atmosphere and further heated at 100° C. for 10 minutes to form a protection layer having a thickness of 3.5 μm. A photosensitive member of Example 1 was manufactured as described above.

Example 2

An electrophotographic photosensitive member was manufactured in the same manner as in the photosensitive member of Example 1, except that a protection layer was formed as follows. A coating liquid for a protection layer was prepared by dissolving 6 parts of a hole transport material represented by Exemplary Compound No. 17 in 7 parts of 1-propanol and 7 parts of ZEORORA H.

The coating liquid for the protection layer was dipped and applied on the hole transport layer, and the same method as in Example 1 was performed to form a protection layer having a thickness of 3.5 μm. A photosensitive member of Example 2 was manufactured as described above.

Example 3

The same aluminum cylinder as used in the photosensitive member of Example 1 was used as a support.

Thereafter, 60 parts of $TiO_2$ particles covered with oxygen-deficient $SnO_2$ (powder resistivity 100 Ω·cm and 35% of coverage ratio (mass ratio) of $SnO_2$) as conductive particles, 36.5 parts of a phenol resin (product name: Plyophen J-325 manufactured by DIC Corporation (old Dai Nippon Ink Kagaku Kogyo Kabushiki Kaisha, 60% of a resin solid content) as a binder resin, and 20 parts of methoxypropanol as a solvent were mixed, and dispersed with a horizontal sand mill disperser using glass beads having a diameter of 1 mm.

After removing the glass beads from the dispersion treatment liquid using a mesh, 1.6 parts of silicone resin particles (product name: TosPearl 120 manufactured by Momentive Performance Materials Co., Ltd. (old GE Toshiba Silicone Co., Ltd.), average particle size: 2 μm) as a surface roughness imparting agent, and 0.008 parts of silicone oil (product name: SH28PA manufactured by Toray Dow Corning Co., Ltd.) as a leveling agent were added to the dispersion treatment liquid, and stirred to prepare a coating liquid for a conductive layer. The $TiO_2$ particles covered with oxygen-deficient $SnO_2$ in the coating liquid for the conductive layer had an average particle size of 0.35 μm. The coating liquid for the conductive layer was dipped and applied on the support, and dried and cured at 140° C. for 30 minutes to form a conductive layer having a thickness of 18 μm.

Then, 10 parts of a methoxymethylated 6 nylon resin (product name: Torejin EF-30T manufactured by Imperial Chemical Industries Ltd.) was dissolved in a mixed solvent of 100 parts of methanol/50 parts of n-butanol, thereby preparing a coating liquid for an undercoat layer. The coating liquid for the undercoat layer was dipped and applied on the conductive layer, and the obtained coating film was dried at 100° C. for 30 minutes to form an undercoat layer having a thickness of 0.45 μm. Subsequently, a charge generation layer and a hole transport layer were formed sequentially in the same manner as in Example 1.

Thereafter, a protection layer having a thickness of 3.5 μm was formed in the same manner as in Example 1, and a photosensitive member of Example 3 was manufactured.

Example 4

A conductive layer, an undercoat layer, a charge generation layer, and a hole transport layer were formed sequentially on the support in the same manner as in Example 3. Thereafter, a protection layer having a thickness of 3.5 μm was formed in the same manner as in Example 2, and a photosensitive member of Example 4 was manufactured.

Example 5

An electrophotographic photosensitive member was manufactured in the same manner as in the photosensitive member of Example 1, except that a protection layer was formed as follows. A coating liquid for a protection layer was prepared by dissolving 6 parts of a hole transport material represented by Exemplary Compound No. 16 in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 5 was manufactured as described above.

Example 6

An electrophotographic photosensitive member was manufactured in the same manner as in the photosensitive member of Example 1, except that a protection layer was formed as follows. A coating liquid for a protection layer was prepared by dissolving 3 parts of a hole transport material represented by Exemplary Compound No. 16 and 3 parts of a hole transport material represented by Formula (E) in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 6 was manufactured as described above.

Example 7

An electrophotographic photosensitive member was manufactured in the same manner as in the photosensitive member of Example 1, except that a protection layer was formed as follows.

A fluorine atom-containing resin (product name: GF-400, Toagosei Company, Limited) (1.5 parts) was dissolved in a mixed solvent of 45 parts of 1-propanol and 45 parts of ZEORORA H. Thereafter, 30 parts of fluorinated ethylene resin powder (product name: ruburon L-2 manufactured by DAIKIN INDUSTRIES, Ltd.) was added and dispersed by a high pressure disperser (product name: Microfluidizer M-110 EH, Microfluidics Co., Ltd., U.S.A.) to obtain a fluorinated ethylene resin dispersion liquid.

A coating liquid for a protection layer was prepared by mixing 2 parts of a hole transport material represented by Exemplary Compound No. 16 and 2 parts of a hole transport material represented by Formula (E) in 8 parts of the fluorinated ethylene resin dispersion liquid, 4 parts of 1-propanol, and 4 parts of ZEORORA H, followed by stirring and uniformly dispersing. The obtained coating liquid for the protection layer was dipped and applied on the hole transport layer, and the same method as in Example 1 was performed to form a protection layer having a thickness of 3.5 μm. A photosensitive member of Example 7 was manufactured as described above.

Example 8

An electrophotographic photosensitive member was manufactured in the same manner as in the photosensitive member of Example 1, except that a protection layer was formed as follows. A coating liquid for a protection layer was prepared by dissolving 6 parts of a hole transport material represented by Exemplary Compound No. 39 in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 8 was manufactured as described above.

Example 9

An electrophotographic photosensitive member was manufactured in the same manner as in the photosensitive member of Example 1, except that a protection layer was formed as follows. A coating liquid for a protection layer was prepared by dissolving 3 parts of a hole transport material represented by Exemplary Compound No. 42 and 3 parts of a hole transport material represented by Formula (E) in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 9 was manufactured as described above.

Example 10

An electrophotographic photosensitive member was manufactured in the same manner as in the photosensitive member of Example 1, except that a protection layer was formed as follows. A coating liquid for a protection layer was prepared by dissolving 4 parts of a hole transport material represented by Exemplary Compound No. 56 and 2 parts of a hole transport material represented by Formula (E) in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 10 was manufactured as described above.

Example 11

The same undercoat layer as in Example 1 was formed on the same aluminum cylinder as in Example 1.

Thereafter, crystalline oxytitanium phthalocyanine crystal (charge generating substance) in which Bragg angle 2θ±0.2° has a peak at 27.2° in CuKα characteristic X-ray diffraction was prepared. The oxytitanium phthalocyanine crystal (2 parts), 1 part of polyvinyl butyral (product name: S-LEC BM-S manufactured by Sekisui Chemical Co., Ltd.), and 50 parts of cyclohexanone were put in a sand mill using glass beads having a diameter of 1 mm and dispersed for 4 hours. Thereafter, 40 parts of ethyl acetate was added to prepare a coating liquid for a charge generation layer. The coating liquid for the charge generation layer was dipped and applied on the undercoat layer, and the obtained coating film was dried at 80° C. for 10 minutes to form a charge generation layer having a thickness of 0.18 μm.

The same hole transport layer as in Example 1 was formed on the charge generation layer.

Then, a coating liquid for a protection layer was prepared by mixing 5.4 parts of a hole transport material represented by Exemplary Compound No. 16, 0.3 parts of 1-hydroxycyclohexyl phenyl ketone as a photopolymerization initiator, 2.4 parts of the same fluorinated ethylene resin dispersion liquid as that prepared in Example 7, 6 parts of 1-propanol, and 6 parts of ZEORORAH, followed by stirring and uniformly dispersing. The obtained coating liquid for the protection layer was dipped and applied on the hole transport layer, and the coating film was dried at 45° C. for 10 minutes, and then photocured under the following conditions.

An aluminum cylinder having the coating film of the coating liquid for the protection layer was rotated at a speed of 100 rpm under an atmosphere of an oxygen concentration of 6000 to 8000 ppm, and light irradiation was performed using a metal halide lamp having an output of 160 W/cm$^2$. The light irradiation was performed under conditions of an irradiation distance of 100 mm, an irradiation intensity of 600 mW/cm$^2$, and an irradiation time of 2 minutes. After the light irradiation, the protection layer having a thickness of 3.5 μm was formed by heating at 135° C. for 30 minutes. A photosensitive member of Example 11 was manufactured as described above.

Example 12

An electrophotographic photosensitive member was manufactured in the same manner as in the photosensitive member of Example 11, except that a protection layer was formed as follows.

A coating liquid for a protection layer was prepared by mixing 2.7 parts of a hole transport material represented by Exemplary Compound No. 16, 2.7 parts of a hole transport material represented by Formula (E), 0.3 parts of 1-hydroxycyclohexyl phenyl ketone as a photopolymerization initiator, 2.4 parts of the same fluorinated ethylene resin dispersion liquid as that prepared in Example 7, 6 parts of 1-propanol, and 6 parts of ZEORORA H, and then applied, dried, and photocured under the same conditions as in Example 11. A protection layer having a thickness of 3.5 μm was formed by heating in the same manner as in Example 11. A photosensitive member of Example 12 was manufactured as described above.

Example 13

An electrophotographic photosensitive member was manufactured in the same manner as in the photosensitive member of Example 1, except that a protection layer was formed as follows. A coating liquid for a protection layer was prepared by dissolving 3 parts of a hole transport material represented by Exemplary Compound No. 13 and 3 parts of a hole transport material represented by Formula (E) in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 13 was manufactured as described above.

Example 14

An electrophotographic photosensitive member was manufactured in the same manner as in the photosensitive member of Example 1, except that a protection layer was formed as follows. A coating liquid for a protection layer was prepared by dissolving 3 parts of a hole transport material represented by Exemplary Compound No. 45 and 3 parts of a hole transport material represented by Formula (E)

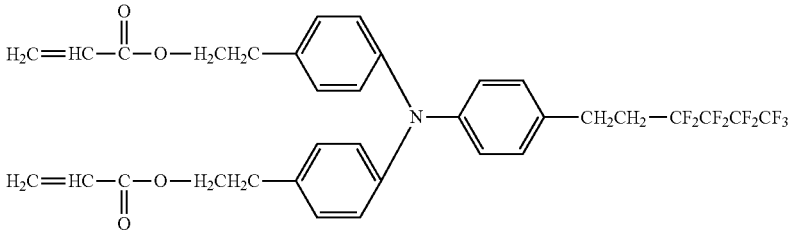

in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Example 14 was manufactured as described above.

Comparative Example 1

An electrophotographic photosensitive member was manufactured in the same manner as in the photosensitive member of Example 1, except that a protection layer was formed as follows. A coating liquid for a protection layer was prepared by dissolving 6 parts of the hole transport material represented by the following Comparative Compound No. 1 in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Comparative Example 1 was manufactured as described above.

[Comparative Compound No. 1]

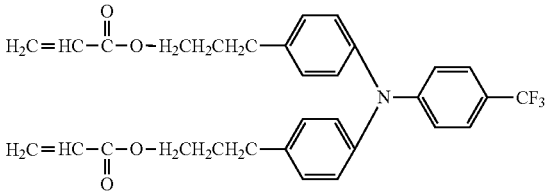

Comparative Example 2

An electrophotographic photosensitive member was manufactured in the same manner as in the photosensitive member of Example 1, except that a protection layer was formed as follows. A coating liquid for a protection layer was prepared by dissolving 6 parts of a hole transport material represented by the following Comparative Compound No. 2 in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Comparative Example 2 was manufactured as described above.

[Comparative Compound No. 2]

Comparative Example 3

An electrophotographic photosensitive member was manufactured in the same manner as in the photosensitive member of Example 1, except that a protection layer was formed as follows. A coating liquid for a protection layer was prepared by dissolving 6 parts of a hole transport material represented by the following Comparative Compound No. 3 in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Comparative Example 3 was manufactured as described above.

[Comparative Compound No. 3]

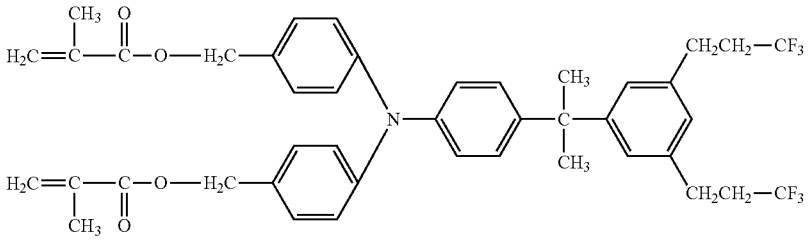

Comparative Example 4

An electrophotographic photosensitive member was manufactured in the same manner as in the photosensitive member of Example 1, except that a protection layer was formed as follows. A coating liquid for a protection layer was prepared by dissolving 4 parts of a hole transport material represented by the following Comparative Compound No. 4 and 2 parts of an acrylic compound having no hole transport structure represented by Formula (F) in 7 parts of 1-propanol and 7 parts of ZEORORA H. The obtained coating liquid for the protection layer was dipped and applied on the hole transport layer, and the same method as in Example 1 was performed to form a protection layer having a thickness of 3.5 μm. A photosensitive member of Comparative Example 4 was manufactured as described above.

[Comparative Compound No. 4]

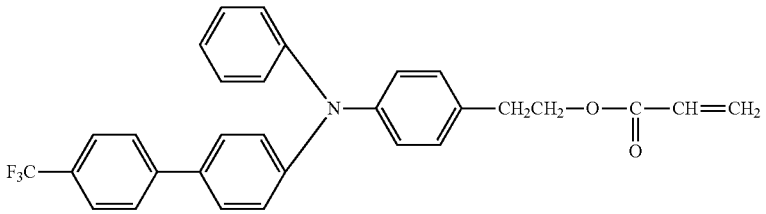

Acrylic Compound Having No Hole Transport Structure

[Formula (F)]

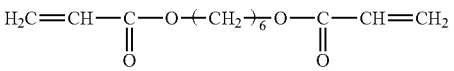

Comparative Example 5

An electrophotographic photosensitive member was manufactured in the same manner as in the photosensitive member of Example 11, except that a protection layer was formed as follows. A protection layer was formed by using 5.4 parts of the hole transport material represented by Comparative Compound No. 2 instead of the hole transport material used for the protection layer in Example 11. A protection layer having a thickness of 3.5 μm was formed in the same manner as in Example 11. A photosensitive member of Comparative Example 5 was manufactured as described above.

<Evaluation: Initial Sensitivity and Residual Potential>

Evaluation of sensitivity and residual potential was performed on the manufactured photosensitive members of Examples 1 to 14 and Comparative Examples 1 to 5 under the following conditions.

First, a condition of a charging apparatus was set so that a surface of the electrophotographic photosensitive member had a potential of −700 V under an environment of a temperature of 23° C./50% RH, using a photosensitive member tester (product name: CYNTHIA59 manufactured by GENTECH, INC.). A light amount required to lower the potential of −700 V to −200 V was measured by irradiating the photosensitive member with monochromatic light having a wavelength of 780 nm, and was determined as a sensitivity ($\mu J/cm^2$). In addition, the potential of the photosensitive member when irradiated with a light amount of 20 ($\mu J/cm^2$) was measured and determined as a residual potential (−V).

<Evaluation: Image Flow Evaluation>

Image flow was evaluated on the manufactured photosensitive members of Examples 1 to 14 and Comparative Examples 1 to 5 under the following conditions.

As an electrophotographic apparatus, a modified copying machine (product name: iR-C3380F manufactured by Canon Inc.) was used. The modification was made so as to be able to adjust and measure a phase exposure laser power, an amount of current flowing from a charging roller to a support of an electrophotographic photosensitive member (hereinafter also referred to as a total current), and a voltage applied to the charging roller. In addition, a cassette heater was removed.

First, the electrophotographic apparatus and the electrophotographic photosensitive member were allowed to stand in an environment of a temperature of 30° C. and a humidity of 80% RH for 24 hours or more, and then the electrophotographic photosensitive members of Examples and Comparative Examples were mounted on a cyan color cartridge of an electrophotographic apparatus.

Thereafter, a solid image output was performed with a cyan solid color on A4 size plain paper, and a phase exposure light amount was determined so that a concentration on the paper was 1.45 using a spectrophotometer (product name: X-rite504 manufactured by X-Rite, Inc.).

Thereafter, an applied voltage was applied from −400 V to −2000 V at an interval of 100 V, and a total current at each applied voltage was measured. In addition, a graph in which the applied voltage was plotted on a horizontal axis and a total current was plotted on a vertical axis was created, and an applied voltage at which a current component (hereinafter also referred to as a discharge current) that deviated from a primary approximate curve at the applied voltage from −400 V to −800 V, was 100 μA, was calculated. The total current was determined as a total current value at the applied voltage at which the discharge current was 100 μA.

Then, a square grid image of A4 size, 0.1 mm in line width, and 10 mm in line spacing was read by a scanner, and 5,000 sheets were successively output in a cyan solid color under an environment of a temperature of 30° C. and a humidity of 80% RH. After the image was output, a main power source of the electrophotographic apparatus was turned off and the electrophotographic apparatus was allowed to stand for 3 days. As soon as the main power of the electrophotographic apparatus was turned on after being allowed to stand, one sheet of the square grid image was output in the same manner, an image flow of an output image was visually observed, and the image flow was evaluated based on the following criteria.

The evaluation rank was as follows.

Rank 5: no abnormality was confirmed in the grid image.

Rank 4: the horizontal line of the grid image was broken, but no abnormality was confirmed on the vertical line.

Rank 3: the horizontal line of the grid image was lost, but no abnormality was confirmed on the vertical line.

Rank 2: the horizontal line of the grid image was lost, and the vertical line was broken.

Rank 1: the horizontal line of the grid image was lost, and the vertical line was also lost.

Here, the horizontal line in the grid image indicates a line parallel to a cylindrical axis direction of the photosensitive member and the vertical line indicates a line perpendicular to the cylindrical axis direction of the photosensitive member.

<Evaluation: Evaluation of Potential Variation and Abrasion Amount when Repeatedly Used in Low Humidity Environment>

The potential variation and the abrasion amount of the protection layer when repeatedly used under a low humidity environment were evaluated on the manufactured photosensitive members of Examples 1 to 14 and Comparative Examples 1 to 5 under the following conditions.

As an electrophotographic apparatus, a modified copying machine (product name: iR ADVANCE C5051F manufactured by Canon Inc.) was used. The modification was made so as to be able to adjust a phase exposure laser power.

First, a protection layer thickness before outputting 50,000 sheets of the electrophotographic photosensitive member was measured using an interference film thickness meter (product name: MCPD-3700 manufactured by Otsuka Electronics Co., Ltd.).

Subsequently, the electrophotographic apparatus and the electrophotographic photosensitive member were allowed to stand in an environment of a temperature of 23° C. and a humidity of 5% RH for 24 hours or more, and then the electrophotographic photosensitive members were mounted on a cyan color cartridge of an electrophotographic apparatus. Thereafter, a condition of a charging apparatus was determined so that a surface of the electrophotographic photosensitive member had a potential of −700 V. A light amount setting for lowering the potential from −700 V to −200 V by adjusting the phase exposure laser power was recorded.

Then, a halftone image output was performed with a cyan solid color in an A4 size plain paper. A phase exposure laser power was determined so that a concentration of the output image was 0.85 by a spectrophotometer (product name: X-rite504 manufactured by X-Rite Inc.), and 50,000 sheets were continuously output in an environment of a temperature of 23° C. and a humidity of 5% RH.

Then, a condition of a charging apparatus was determined so that a surface of the electrophotographic photosensitive member had a potential of −700 V, then the initially recorded phase exposure laser power was readjusted, and a surface potential at that time was read. An increase/decrease of an absolute value of the potential was measured as a potential variation amount by repeated use.

Then, the electrophotographic photosensitive member was taken out from the electrophotographic apparatus, and a thickness of the protection layer after outputting 50,000 sheets was measured to calculate a difference in thickness of the protection layer before and after outputting 50,000 sheets, that is, the abrasion amount. Table 1 shows evaluation results above.

TABLE 1

| | | Photosensitive member evaluation result | | | | |
|---|---|---|---|---|---|---|
| | Hole transport material of surface layer | Sensitivity [μJ/cm$^2$] | Residual potential [−V] | Potential variation [V] | Image flow [rank] | Abrasion amount [μm] |
| Example 1 | Mixture of Exemplary Compound No. 5 and Formula (E) | 0.27 | 24 | 20 | 4 | 0.6 |
| Example 2 | Exemplary Compound No. 17 | 0.28 | 32 | 19 | 5 | 0.4 |
| Example 3 | Mixture of Exemplary Compound No. 5 and Formula (E) | 0.27 | 25 | 21 | 4 | 0.6 |
| Example 4 | Exemplary Compound No. 17 | 0.28 | 31 | 19 | 5 | 0.4 |
| Example 5 | Exemplary Compound No. 16 | 0.28 | 30 | 20 | 5 | 0.3 |
| Example 6 | Mixture of Exemplary Compound No. 16 and Formula (E) | 0.27 | 28 | 24 | 5 | 0.3 |
| Example 7 | Mixture of Exemplary Compound No. 16 and Formula (E) | 0.27 | 31 | 24 | 5 | 0.5 |
| Example 8 | Exemplary Compound No. 39 | 0.28 | 32 | 33 | 4 | 0.5 |
| Example 9 | Mixture of Exemplary Compound No. 42 and Formula (E) | 0.28 | 30 | 29 | 5 | 0.5 |

TABLE 1-continued

| | Hole transport material of surface layer | Photosensitive member evaluation result | | | | |
|---|---|---|---|---|---|---|
| | | Sensitivity [μJ/cm$^2$] | Residual potential [−V] | Potential variation [V] | Image flow [rank] | Abrasion amount [μm] |
| Example 10 | Mixture of Exemplary Compound No. 56 and Formula (E) | 0.27 | 25 | 22 | 4 | 0.5 |
| Example 11 | Exemplary Compound No. 16 | 0.30 | 43 | 38 | 4 | 0.6 |
| Example 12 | Mixture of Exemplary Compound No. 16 and Formula (E) | 0.29 | 40 | 36 | 4 | 0.6 |
| Example 13 | Mixture of Exemplary Compound No. 13 and Formula (E) | 0.28 | 32 | 26 | 5 | 0.5 |
| Example 14 | Mixture of Exemplary Compound No. 45 and Formula (E) | 0.29 | 36 | 28 | 5 | 0.6 |
| Comparative Example 1 | Comparative Compound No. 1 | 0.46 | 144 | Not measurable | Not measurable | 0.6 |
| Comparative Example 2 | Comparative Compound No. 2 | 0.34 | 40 | 132 | 2 | 0.8 |
| Comparative Example 3 | Comparative Compound No. 3 | 0.35 | 61 | 98 | 2 | 0.8 |
| Comparative Example 4 | Mixture of Comparative Compound No. 4 and Formula (F) | 0.36 | 108 | 110 | 2 | 0.6 |
| Comparative Example 5 | Comparative Compound No. 2 | 0.35 | 66 | 91 | 2 | 0.8 |

With respect to the photosensitive member of Comparative Example 1, since a hole transport ability of a hole transport compound was lowered, residual potential was high from the beginning, and the residual potential was further increased by repeated use. Image output could not be performed during continuous use, and the image flow evaluation could not be performed. In addition, under a low humidity environment, the residual potential was very high from the beginning, and thus the potential variation by repeated use could not be evaluated.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-101077, filed May 22, 2017, which is hereby incorporated by reference herein in its entirety.

What is claimed is:

1. An electrophotographic photosensitive member, comprising:

a support; and a photosensitive layer on the support, wherein a surface layer of the electrophotographic photosensitive member contains a polymer of a hole transport compound having at least one monovalent polymerizable functional group, the hole transport compound being represented by Formula (1)

(1)

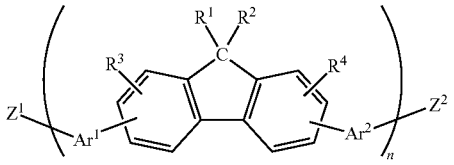

where $R^1$ and $R^2$ independently represent a hydrogen atom, a fluorine atom, an alkyl group, a fluorine atom-substituted alkyl group, a phenyl group-substituted alkyl group, a phenyl group, an alkyl group-substituted phenyl group, an alkyl group having said monovalent polymerizable functional group as a substituent, a phenyl group-substituted alkyl group having said monovalent polymerizable functional group as a substituent, a phenyl group having said monovalent polymerizable functional group as a substituent, or an alkyl group-substituted phenyl group having said monovalent polymerizable functional group as a substituent, and at least one of $R^1$ and $R^2$ is a trifluoromethyl group, $R^3$ and $R^4$ independently represent a hydrogen atom, an alkyl group, an alkoxy group, a phenyl group, an alkyl group having said monovalent polymerizable functional group as a substituent, an alkoxy group having said monovalent polymerizable functional group as a substituent, or a phenyl group having said monovalent polymerizable functional group as a substituent, $Ar^1$ and $Ar^2$ independently represent a single bond, an arylene group, or an alkyl group-substituted arylene group, n represents an integer of 1 to 5, when n is 2 or more, structures in parentheses may be the same or different from each other, $Z^1$ represents a monovalent group represented by Formula (2), and $Z^2$ represents a hydrogen atom or the monovalent group represented by Formula (2), with the proviso that when $Z^2$ is represented by Formula (2), $Z^1$ and $Z^2$ may be the same or different from each other, (2)

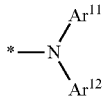

where * represents a bonding position at which $Ar^1$ or $Ar^2$ is bonded, and $Ar^{11}$ and $Ar^{12}$ independently represent an aryl group, an alkyl group-substituted aryl group, an alkoxy group-substituted aryl group, an aryl group having said monovalent polymerizable functional group as a substituent, an alkyl group-substituted aryl group having said monovalent polymerizable functional group as a substituent, or an alkoxy group-substituted aryl group having said monovalent polymerizable functional group as a substituent; and said monovalent polymerizable functional group is represented by Formula (3)

(3)

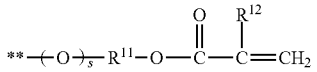

where ** represents a bonding position at which $R^1$ to $R^4$, $Ar^{11}$ and $Ar^{12}$ are bonded, $R^{11}$ represents a single bond or an alkylene group having 6 or less carbon atoms, $R^{12}$ represents a hydrogen atom or a methyl group, and s is 0 or 1, with the proviso that when s is 1, $R^{11}$ is not a single bond, and with the proviso that when the number of groups having a monovalent polymerizable functional group is 2 or more, their structures may be the same or different from each other.

2. The electrophotographic photosensitive member according to claim 1, wherein n is an integer of 1 to 3.

3. The electrophotographic photosensitive member according to claim 1, wherein $R^{11}$ is $C_{2-5}$ alkylene group.

4. The electrophotographic photosensitive member according to claim 1, wherein the compound represented by Formula (1) contains at least two polymerizable functional groups.

5. An electrophotographic apparatus comprising an electrophotographic photosensitive member and at least one unit selected from the group consisting of a charging unit, an exposing unit, a developing unit, a transfer unit and a cleaning unit, the electrophotographic photosensitive member comprising:

a support; and a photosensitive layer on the support, wherein a surface layer of the electrophotographic photosensitive member contains a polymer of a hole transport compound having at least one monovalent polymerizable functional group, the hole transport compound being represented by Formula (1)

(1)

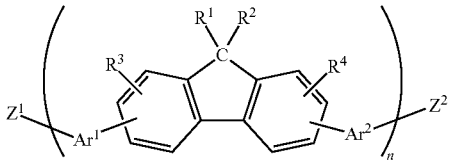

where $R^1$ and $R^2$ independently represent a hydrogen atom, a fluorine atom, an alkyl group, a fluorine atom-substituted alkyl group, a phenyl group-substituted alkyl group, a phenyl group, an alkyl group-substituted phenyl group, an alkyl group having said monovalent polymerizable functional group as a substituent, a phenyl group-substituted alkyl group having said monovalent polymerizable functional group as a substituent, a phenyl group having said monovalent polymerizable functional group as a substituent, or an alkyl group-substituted phenyl group having said monovalent polymerizable functional group as a substituent, and at least one of $R^1$ and $R^2$ is a trifluoromethyl group, $R^3$ and $R^4$ independently represent a hydrogen atom, an alkyl group, an alkoxy group, a phenyl group, an alkyl group having said monovalent polymerizable functional group as a substituent, an alkoxy group having said monovalent polymerizable functional group as a substituent, or a phenyl group having said monovalent polymerizable functional group as a substituent, $Ar^1$ and $Ar^2$ independently represent a single bond, an arylene group, or an alkyl group-substituted arylene group, n represents an integer of 1 to 5, when n is 2 or more, structures in parentheses may be the same or different from each other, $Z^1$ represents a monovalent group represented by Formula (2), and $Z^2$ represents a hydrogen atom or the monovalent group represented by Formula (2), with the proviso that when $Z^2$ is represented by Formula (2), $Z^1$ and $Z^2$ may be the same or different from each other, (2)

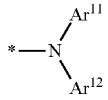

where * represents a bonding position at which $Ar^1$ or $Ar^2$ is bonded, and $Ar^{11}$ and $Ar^{12}$ independently represent an aryl group, an alkyl group-substituted aryl group, an alkoxy group-substituted aryl group, an aryl group having said monovalent polymerizable functional group as a substituent, an alkyl group-substituted aryl group having said monovalent polymerizable functional group as a substituent, or an alkoxy group-substituted aryl group having said monovalent polymerizable functional group as a substituent; and said monovalent polymerizable functional group is represented by Formula (3)

(3)

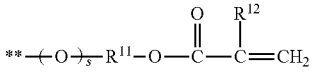

where ** represents a bonding position at which $R^1$ to $R^4$, $Ar^{11}$ and $Ar^{12}$ are bonded, $R^{11}$ represents a single bond or an alkylene group having 6 or less carbon atoms, $R^{12}$ represents a hydrogen atom or a methyl group, and s is 0 or 1, with the proviso that when s is 1, $R^{11}$ is not a single bond, and with the proviso that when the number of groups having a monovalent polymerizable functional group is 2 or more, their structures may be the same or different from each other.

6. A process cartridge comprising an electrophotographic photosensitive member and at least one unit that is integrally supported, the at least one unit being selected from the group consisting of a charging unit, a developing unit and a cleaning unit, the process cartridge being detachably attachable to an electrophotographic apparatus main body, the electrophotographic photosensitive member comprising:

a support; and a photosensitive layer on the support, wherein a surface layer of the electrophotographic photosensitive member contains a polymer of a hole transport compound having at least one monovalent polymerizable functional group, the hole transport compound being represented by Formula (1)

(1)

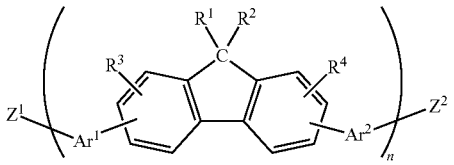

where $R^1$ and $R^2$ independently represent a hydrogen atom, a fluorine atom, an alkyl group, a fluorine atom-substituted alkyl group, a phenyl group-substituted alkyl group, a phenyl group, an alkyl group-substituted phenyl group, an alkyl group having said monovalent polymerizable functional group as a substituent, a phenyl group-substituted alkyl group having said monovalent polymerizable functional group as a substituent, a phenyl group having said monovalent polymerizable functional group as a substituent, or an alkyl group-substituted phenyl group having said monovalent polymerizable functional group as a substituent, and at least one of $R^1$ and $R^2$ is a trifluoromethyl group, $R^3$ and $R^4$ independently represent a hydrogen atom, an alkyl group, an alkoxy group, a phenyl group, an alkyl group having said monovalent polymerizable functional group as a substituent, an alkoxy group having said monovalent polymerizable functional group as a substituent, or a phenyl group having said monovalent polymerizable functional group as a substituent, $Ar^1$ and $Ar^2$ independently represent a single bond, an arylene group, or an alkyl group-substituted arylene group, n represents an integer of 1 to 5, when n is 2 or more, structures in parentheses may be the same or different from each other, $Z^1$ represents a monovalent group represented by Formula (2), and $Z^2$ represents a hydrogen atom or the monovalent group represented by Formula (2), with the proviso that when $Z^2$ is represented by Formula (2), $Z^1$ and $Z^2$ may be the same or different from each other, (2)

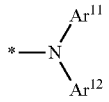

where * represents a bonding position at which $Ar^1$ or $Ar^2$ is bonded, and $Ar^{11}$ and $Ar^{12}$ independently represent an aryl group, an alkyl group-substituted aryl group, an alkoxy group-substituted aryl group, an aryl group having said monovalent polymerizable functional group as a substituent, an alkyl group-substituted aryl group having said monovalent polymerizable functional group as a substituent, or an alkoxy group-substituted aryl group having said monovalent polymerizable functional group as a substituent; and said monovalent polymerizable functional group is represented by Formula (3)

(3)

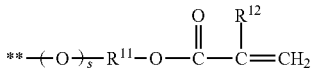

where ** represents a bonding position at which $R^1$ to $R^4$, $Ar^{11}$ and $Ar^{12}$ are bonded, $R^{11}$ represents a single bond or an alkylene group having 6 or less carbon atoms, $R^{12}$ represents a hydrogen atom or a methyl group, and s is 0 or 1, with the proviso that when s is 1, $R^{11}$ is not a single bond, and with the proviso that when the number of groups having a monovalent polymerizable functional group is 2 or more, their structures may be the same or different from each other.

* * * * *